US010465366B2

(12) United States Patent
Grover et al.

(10) Patent No.: US 10,465,366 B2
(45) Date of Patent: Nov. 5, 2019

(54) SANITARYWARE CLEANING SYSTEM

(71) Applicant: AS AMERICA, INC., Piscataway, NJ (US)

(72) Inventors: David Grover, Hamilton, NJ (US); Daigo Ishiyama, Summit, NJ (US); Timothy J. Payne, Chicago, IL (US); Mark Kurth, La Porte, IN (US); Scott Rote, Mokena, IL (US); Phil Anthony, Chicago, IL (US); Aaron B. Eiger, Chicago, IL (US); Chris Helmstetter, Bridgewater, NJ (US); Christophe Bucher, Hillsborough, NJ (US); Ki Bok Song, Plainview, NY (US); Jean-Jacques L'Henaff, New Canaan, CT (US)

(73) Assignee: AS AMERICA, INC., Piscataway, NJ (US)

( * ) Notice: Subject to any disclaimer, the term of this patent is extended or adjusted under 35 U.S.C. 154(b) by 0 days.

(21) Appl. No.: 15/415,502

(22) Filed: Jan. 25, 2017

(65) Prior Publication Data

US 2017/0130437 A1 May 11, 2017

Related U.S. Application Data

(63) Continuation-in-part of application No. 14/723,003, filed on May 27, 2015, now Pat. No. 10,294,643.
(Continued)

(51) Int. Cl.

| | |
|---|---|
| ***E03D 9/03*** | (2006.01) |
| ***A47K 13/26*** | (2006.01) |
| *E03D 9/02* | (2006.01) |

(52) U.S. Cl.
CPC ..... *E03D 9/031* (2013.01); *A47K 13/26* (2013.01); *E03D 2009/024* (2013.01); *E03D 2009/028* (2013.01)

(58) Field of Classification Search
CPC .. E03D 9/03; E03D 9/031; E03D 9/02; E03D 9/022; E03D 2009/024; E03D 2009/026; E03D 2009/028; A47K 13/26
(Continued)

(56) References Cited

U.S. PATENT DOCUMENTS

| | | | |
|---|---|---|---|
| 1,178,852 | A | 4/1916 | Grant |
| 1,211,137 | A | 1/1917 | Grant |

(Continued)

FOREIGN PATENT DOCUMENTS

| | | | |
|---|---|---|---|
| AU | 750000 | B2 | 7/2002 |
| BR | 1005206 | A2 | 12/2010 |

(Continued)

OTHER PUBLICATIONS

Fluidmaster, Flush n' Sparkle, Apr. 29, 2015, 4 pages, http://www.fluidmaster.com/blog/flush-n-sparkle.

(Continued)

*Primary Examiner* — Tuan N Nguyen
(74) *Attorney, Agent, or Firm* — Venable LLP; Michele V. Frank

(57) ABSTRACT

A cleaning system for a sanitary fixture (e.g., toilet) can include a cleanser assembly, housing a compartment formed in the deck of the fixture in fluid communication with a waterway leading to the bowl. The cleanser assembly can receive a cartridge containing a cleaning product for insertion into the compartment and introduction into the waterway. The assembly can support the seat and cover of the fixture, and can have a low profile and curved shape that complements the corresponding shape of the seat and cover, and provides a balanced look that makes the assembly appear to be an integral part of the sanitary fixture.

20 Claims, 36 Drawing Sheets

Related U.S. Application Data

(60) Provisional application No. 62/003,222, filed on May 27, 2014.

(58) Field of Classification Search
USPC ..... 4/226.1
See application file for complete search history.

(56) References Cited

U.S. PATENT DOCUMENTS

| | | | | |
|---|---|---|---|---|
| 2,950,959 | A | | 8/1960 | Ve Relle |
| 3,694,354 | A | | 9/1972 | Nolte, Jr. |
| 3,768,104 | A | | 10/1973 | Sanderson |
| 3,867,101 | A | | 2/1975 | Herring |
| 3,943,243 | A | | 3/1976 | Kook et al. |
| 3,946,448 | A | | 3/1976 | Sioufy |
| 4,117,560 | A | | 10/1978 | Kidon et al. |
| 4,216,027 | A | | 8/1980 | Wages |
| 4,229,410 | A | | 10/1980 | Kosti |
| 4,382,304 | A | | 5/1983 | Lehmann et al. |
| 4,432,102 | A | | 2/1984 | Woodruff et al. |
| 4,450,594 | A | | 5/1984 | Hotchkin et al. |
| 4,557,926 | A | | 12/1985 | Nelson et al. |
| 4,561,130 | A | * | 12/1985 | Bumgardner ..... A47K 13/242 4/236 |
| 4,597,941 | A | | 7/1986 | Bottom et al. |
| 4,654,341 | A | | 3/1987 | Nelson et al. |
| 4,668,475 | A | | 5/1987 | Meloy et al. |
| 4,707,866 | A | | 11/1987 | Von Philipp et al. |
| 4,709,423 | A | | 12/1987 | Richards et al. |
| 4,745,638 | A | | 5/1988 | Richards et al. |
| 4,800,066 | A | | 1/1989 | Sinclair et al. |
| 4,915,260 | A | | 4/1990 | Jones et al. |
| 5,603,126 | A | | 2/1997 | Scoggins |
| 5,689,837 | A | | 11/1997 | Katona |
| 5,759,574 | A | | 6/1998 | Bothe |
| 5,778,459 | A | | 7/1998 | Guerin |
| 5,881,396 | A | | 3/1999 | Rivera et al. |
| 5,910,475 | A | | 6/1999 | Neumiller et al. |
| 5,924,142 | A | | 7/1999 | Wang |
| 5,987,655 | A | | 11/1999 | Smet et al. |
| 6,000,067 | A | | 12/1999 | Cascia |
| 6,055,679 | A | | 5/2000 | Goelz et al. |
| 6,124,251 | A | | 9/2000 | Rader et al. |
| 6,151,722 | A | | 11/2000 | Lubrano |
| 6,211,128 | B1 | | 4/2001 | Black |
| 6,247,189 | B1 | | 6/2001 | Dean et al. |
| 6,321,392 | B1 | | 11/2001 | Sim |
| 6,339,850 | B1 | | 1/2002 | Gore |
| 6,341,385 | B1 | | 1/2002 | Downes |
| 6,440,915 | B2 | | 8/2002 | Rader et al. |
| 6,447,722 | B1 | | 9/2002 | Rakestraw |
| 6,449,779 | B1 | | 9/2002 | Nguyen |
| 6,651,260 | B1 | | 11/2003 | Dodson |
| 6,662,379 | B2 | | 12/2003 | Nguyen et al. |
| 6,713,441 | B1 | | 3/2004 | DeSenna et al. |
| 6,790,353 | B2 | | 9/2004 | Connelly, Jr. |
| 6,833,340 | B2 | | 12/2004 | Lefenfeld et al. |
| 7,007,312 | B1 | | 3/2006 | Sim |
| 7,073,209 | B1 | | 7/2006 | McCormick |
| 7,234,175 | B2 | | 6/2007 | Wilson et al. |
| 7,563,756 | B2 | | 7/2009 | Brady |
| 7,721,358 | B2 | | 5/2010 | Park et al. |
| 7,934,271 | B2 | | 5/2011 | Soller et al. |
| 8,095,997 | B2 | | 1/2012 | Harris |
| 8,209,788 | B2 | | 7/2012 | Takamine et al. |
| 8,266,728 | B2 | | 9/2012 | Bulala et al. |
| 8,307,467 | B2 | | 11/2012 | Bulala et al. |
| 8,316,475 | B2 | | 11/2012 | Grover |
| 8,484,791 | B2 | | 7/2013 | Lin |
| 8,631,518 | B1 | | 1/2014 | Belliard et al. |
| 8,631,519 | B1 | | 1/2014 | Belliard et al. |
| 8,719,971 | B2 | | 5/2014 | Burt et al. |
| 8,806,668 | B2 | | 8/2014 | Lin et al. |
| 8,925,119 | B2 | | 1/2015 | Burt |
| 2002/0061831 | A1 | | 5/2002 | Kaziska et al. |
| 2003/0075205 | A1 | | 4/2003 | Roberson |
| 2004/0040074 | A1 | | 3/2004 | Leonard et al. |
| 2004/0099562 | A1 | | 5/2004 | Vazquez |
| 2004/0128750 | A1 | | 7/2004 | Cramer |
| 2005/0204459 | A1 | | 9/2005 | Selenke |
| 2005/0247725 | A1 | | 11/2005 | Smith |
| 2006/0130221 | A1 | | 6/2006 | Bulala et al. |
| 2006/0137081 | A1 | | 6/2006 | Ferrara et al. |
| 2006/0242754 | A1 | | 11/2006 | Coppock |
| 2007/0039087 | A1 | | 2/2007 | Bringmann |
| 2007/0214555 | A1 | | 9/2007 | Ferrara et al. |
| 2007/0256226 | A1 | | 11/2007 | Pinizzotto |
| 2007/0289054 | A1 | | 12/2007 | Han et al. |
| 2008/0028505 | A1 | | 2/2008 | Penn |
| 2009/0217447 | A1 | | 9/2009 | Matsushita et al. |
| 2009/0241247 | A1 | | 10/2009 | Thurin et al. |
| 2009/0265842 | A1 | | 10/2009 | Higgins et al. |
| 2010/0180365 | A1 | | 7/2010 | Shasho |
| 2013/0298320 | A1 | | 11/2013 | Duncan |
| 2013/0305445 | A1 | | 11/2013 | Stammel et al. |
| 2015/0013058 | A1 | | 1/2015 | Bucher et al. |
| 2015/0074888 | A1 | | 3/2015 | Coulter et al. |
| 2015/0345123 | A1 | | 12/2015 | Grover et al. |

FOREIGN PATENT DOCUMENTS

| | | | |
|---|---|---|---|
| CN | 102899197 | B | 6/2014 |
| DE | 2460109 | A1 | 6/1976 |
| DE | 3805561 | A1 | 8/1989 |
| DE | 29714817 | U1 | 4/1998 |
| DE | 10246866 | A1 | 4/2004 |
| EP | 0070720 | B1 | 10/1986 |
| EP | 1046756 | A1 | 10/2000 |
| EP | 1426505 | A3 | 4/2005 |
| EP | 1533427 | A1 | 5/2005 |
| EP | 1561870 | A1 | 8/2005 |
| EP | 1087067 | B1 | 10/2005 |
| EP | 1640517 | A1 | 3/2006 |
| EP | 2620489 | A1 | 7/2013 |
| EP | 2620490 | A1 | 7/2013 |
| EP | 2141221 | B1 | 10/2013 |
| EP | 2775052 | A1 | 9/2014 |
| EP | 2789754 | A3 | 3/2016 |
| FR | 2572919 | A | 5/1986 |
| FR | 2610815 | A1 | 8/1988 |
| FR | 2775995 | B1 | 9/2000 |
| FR | 2808819 | A1 | 11/2001 |
| FR | 2916772 | A1 | 12/2008 |
| FR | 2970488 | A1 | 7/2012 |
| GB | 190917085 | A | 1/1910 |
| GB | 466414 | A | 5/1937 |
| JP | 3-50677 | U | 5/1991 |
| JP | 3015390 | U | 8/1995 |
| JP | 2014055446 | A | 3/2014 |
| WO | 199316242 | | 8/1993 |
| WO | 1997017571 | | 5/1997 |
| WO | 199316242 | | 8/1998 |
| WO | 2001006067 | A2 | 1/2001 |
| WO | 2007010311 | A1 | 1/2007 |
| WO | 2008062364 | A1 | 5/2008 |
| WO | 2008145962 | A1 | 12/2008 |
| WO | 2010087700 | A2 | 8/2010 |
| WO | 2015072848 | A1 | 5/2015 |
| WO | 2015133976 | A1 | 9/2015 |
| WO | 2016096369 | A1 | 6/2016 |
| WO | 2016139493 | A1 | 9/2016 |
| WO | 2016168881 | A1 | 10/2016 |

OTHER PUBLICATIONS

International Search Report, International Patent Application No. PCT/US2015/32648, International Filing Date, May 27, 2015, dated Oct. 16, 2015.

Chinese Office Action dated Jul. 23, 2018 issued in corresponding Chinese Application No. 201580026759.X (9 pages).

International Search Report with Written Opinion dated Feb. 23, 2018 issued in corresponding International Application No. PCT/US2018/015297 (6 pages).

(56) References Cited

OTHER PUBLICATIONS

Colombian Office Action dated May 8, 2018 issued in corresponding Colombian Application No. NC2016/0005109 with English translation (10 pages).
Japanese Office Action dated Mar. 23, 2018 issued in corresponding Japanese Application No. 2016-568507 with English translation (8 pages).
Extended European Search Report dated Jun. 12, 2018 issued in corresponding European Application No. 15799038.3 (8 pages).
Office Action in related Japanese Application No. 2016-568507, dated Feb. 25, 2019 (9 pages).
Office Action in Chinese Patent Application No. 201580026759.X, dated Apr. 10, 2019, with English language machine translation (11 pages).

* cited by examiner

FIG. 14A
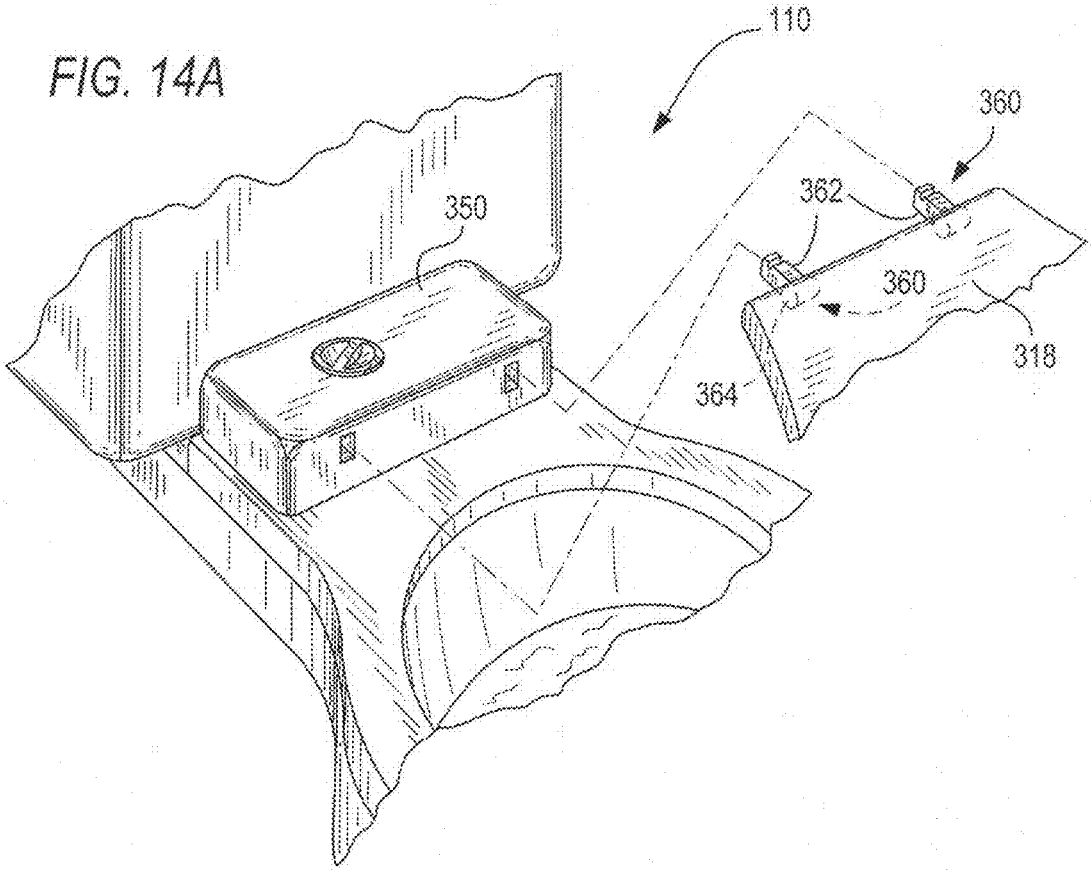
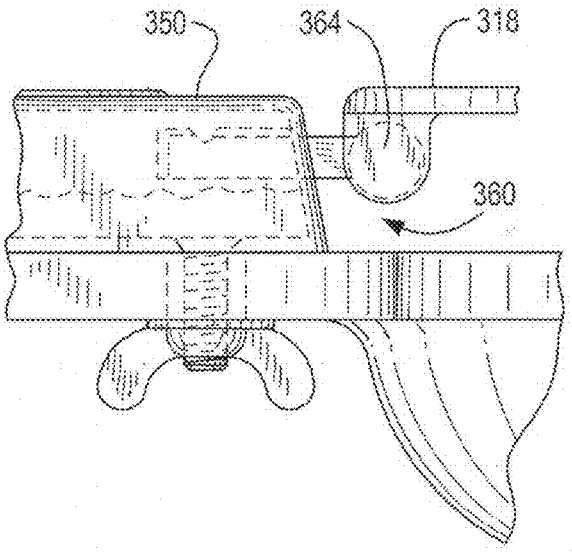
FIG. 14B

FIG. 17
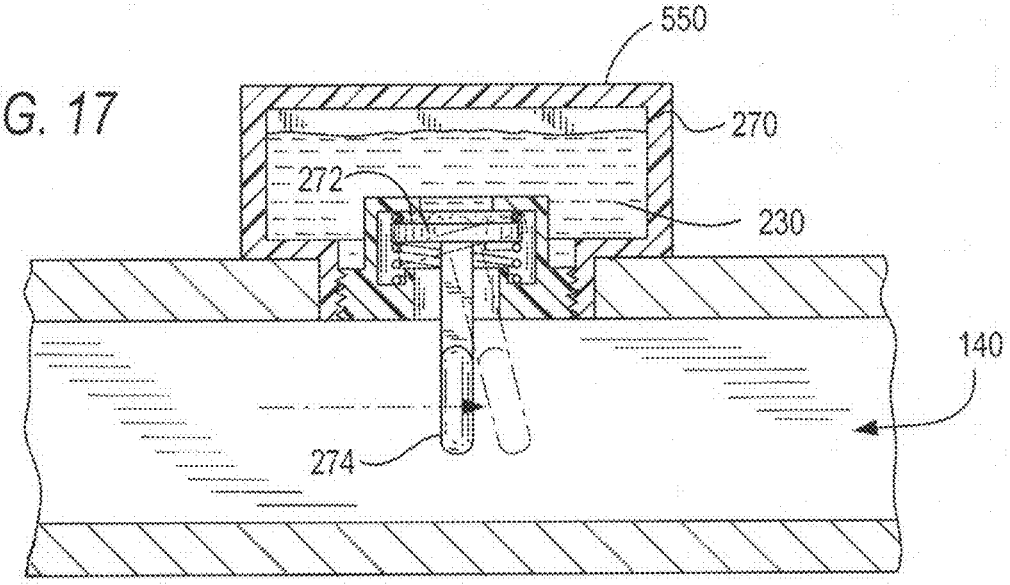
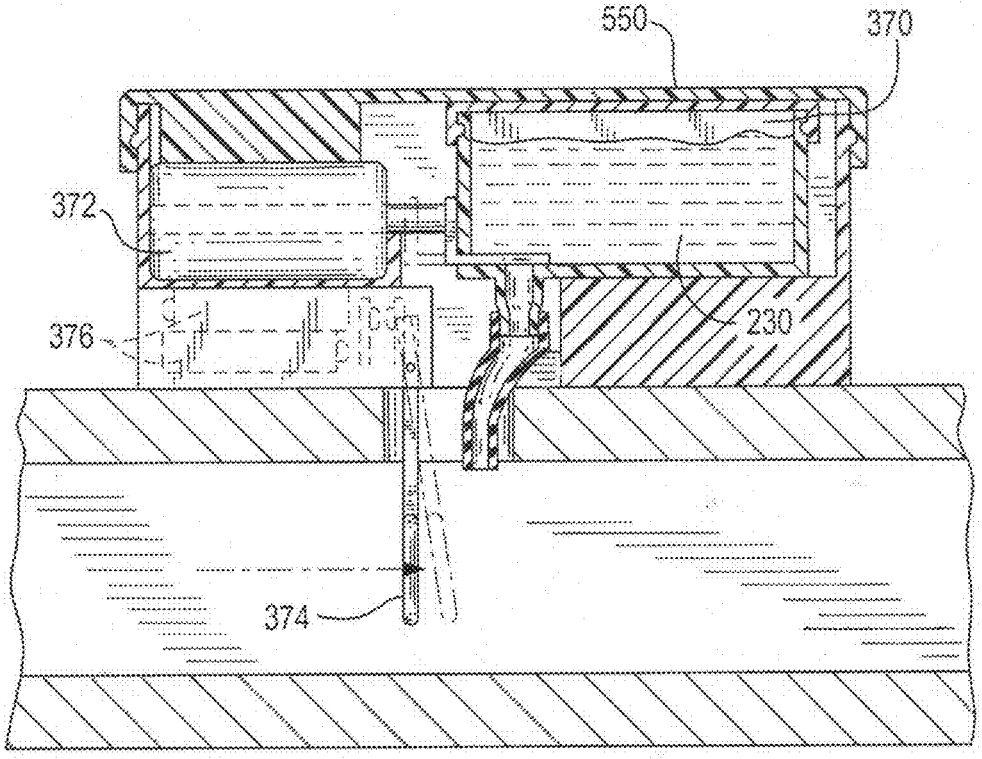
FIG. 18

FIG. 21A
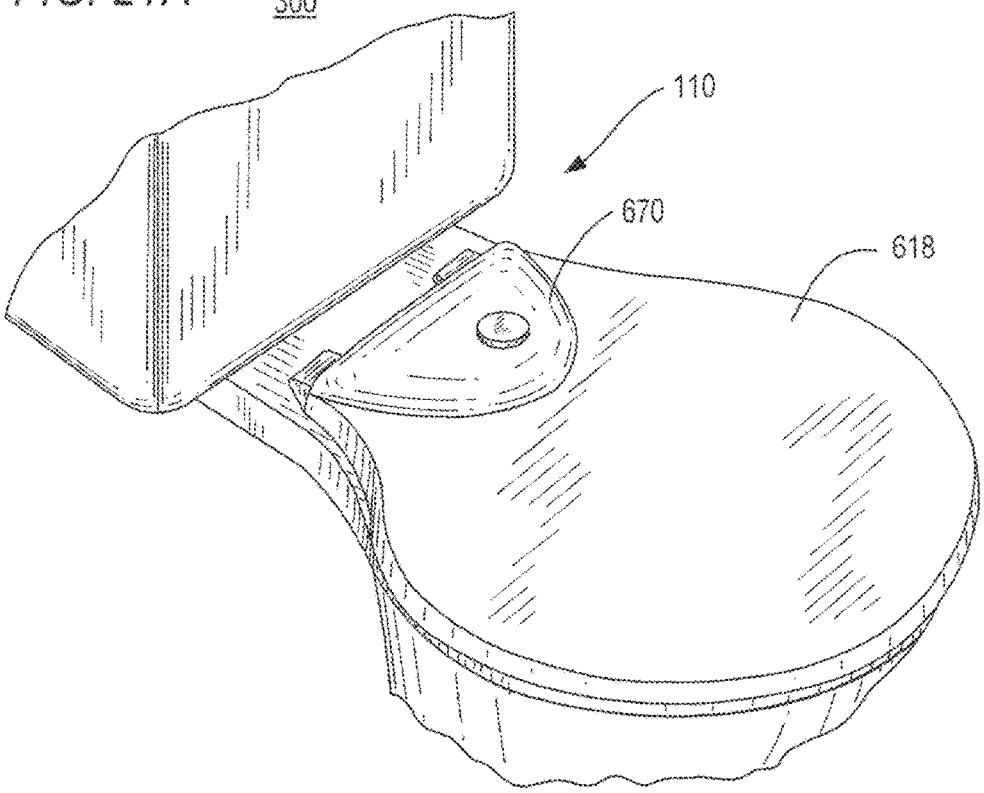
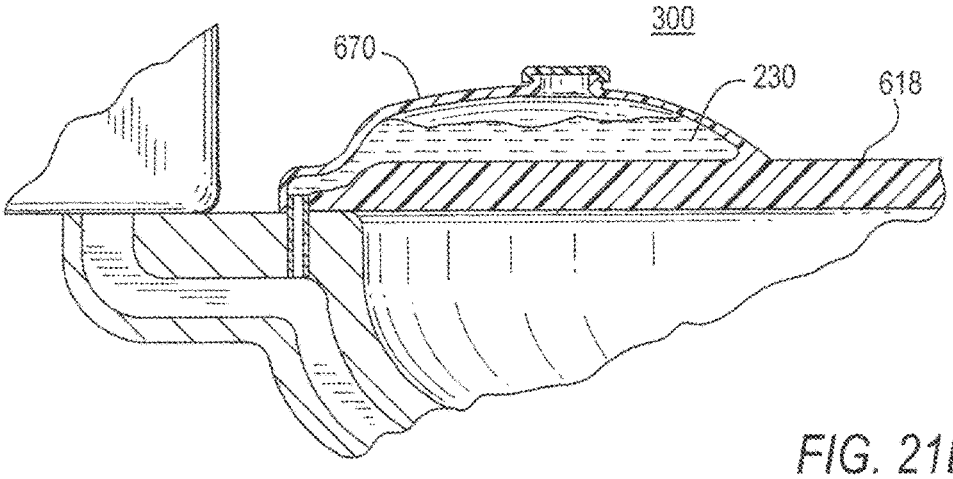
FIG. 21B

D-D

SANITARYWARE CLEANING SYSTEM

CROSS-REFERENCE TO RELATED APPLICATIONS

This application is a continuation-in-part of U.S. Non-Provisional patent application Ser. No. 14/723,003, entitled "SANITARYWARE CLEANING SYSTEM," filed on May 27, 2015, which claims the benefit of U.S. Provisional Patent Application 62/003,222, entitled "SANITARYWARE CLEANING SYSTEM," filed on May 27, 2014, all the disclosures of which are incorporated by reference herein in their entireties.

FIELD OF THE INVENTION

The present invention generally relates to systems and methods for cleaning sanitary fixtures, such as toilets.

BACKGROUND OF THE INVENTION

Automatically dispensing disinfecting and deodorizing sanitaryware cleaning products are a boon to commercial and residential applications. These products can minimize the time and effort required to clean sanitary fixtures, such as for example toilets, by extending the time periods between manual cleanings, or eliminating the need for manual cleaning altogether, while keeping the fixtures and their environs tidy and fresh. Toilet cleaning products typically include a cleaning material formed into a water-soluble tablet. The tablet is then situated within either the toilet tank or toilet bowl such that when the toilet is flushed, some of the flushing water interacts with the tablet, dissolves some of the cleaning material, and dispenses the material into the toilet bowl.

Cleaning agents in the tablets can include chemicals that can degrade components of the toilet tank and toilet bowl and can be harmful upon direct contact with human skin. Situating the cleaning tablets in the tank or bowl, especially in locations that require a person to manually replace the tablets when they are spent, can therefore be undesirable. Toilet tank and toilet bowl placed cleaning products also put the unsightly tablets or tablet housings in plain view, detracting from otherwise clean, uninterrupted lines of the sanitary fixture and presenting a hazard to children and pets.

Flush toilets can be classified into three general categories depending on the design of the hydraulic channels used to achieve the flushing action: non-jetted, rim-jetted, and direct-jetted toilets. In non-jetted bowl designs, all of the flush water exits the tank into a bowl inlet area and flows through a primary manifold into the rim channel. The water can be dispersed around the perimeter of the bowl via a series of holes positioned underneath the rim. Although they can generally be inferior to other designs with respect to flushing power and efficiency, non-jetted bowls are well suited for the invention described herein since all of the dissolved cleaning fluid would be distributed around the rim of the bowl, achieving greater cleaning efficacy.

The bulk waste removal in toilets may be improved over non-jetted designs by incorporating "siphon jets." In a rim-jetted toilet bowl, the flush water exits the tank, flows through the manifold inlet area and through the primary manifold into the rim channel. A portion of the water is dispersed around the perimeter of the bowl via a series of holes positioned underneath the rim. The remaining water flows through a jet channel positioned at the front of the rim. This jet channel connects the rim channel to a jet opening positioned in the sump of the bowl, which is sized and positioned to send a powerful stream of water directly at the opening of the trapway.

In a direct-jetted bowl, the flush water exits the tank and flows through the bowl inlet and through the primary manifold. At this point, the water is divided into two portions: a portion that flows through a rim inlet port to the rim channel with the primary purpose of achieving the desired bowl cleansing, and a portion that flows through a jet inlet port to a "direct-jet channel" that connects the primary manifold to a jet opening in the sump of the toilet bowl (see for example, U.S. Pat. No. 8,316,475).

A new toilet has been described in U.S. Patent Application No. 61/810,664, "Primed Siphonic Flush Toilet," the disclosure of which is incorporated by reference herein in its entirety. This new toilet construction utilizes isolated rim and jet channels.

SUMMARY OF THE INVENTION

Generally speaking, it is an object of the present invention to provide a sanitaryware cleaning system that avoids disadvantages of prior art constructions.

According to an embodiment of the present invention, a sanitary fixture, such as a toilet, may include a compartment between the toilet tank and the bowl for receiving and housing a cleaning product. The compartment may situate the cleaning product in the flow path at any point downstream of the flush valve and upstream of the outlet ports of the toilet rim such that, with every flush, water flowing past the cleaning product injects cleaning material into the bowl via the rim outlet ports. In some embodiments, a perforated or slotted basket may hold the tablet within the compartment while simultaneously allowing water to flow from the tank, past the cleaning tablet, and into the toilet bowl. In alternative embodiments, the cleaning product may be tethered to a cap to permit the tablet to move freely in the water path with or without the use of a basket.

In some embodiments, a cap can cover the compartment with a water-tight fit to seal the system from leaks. The cap may further utilize a child-resistant design to prevent access by children and pets. The visible portion of the cap can be color-matched to the surface of the sanitary fixture or otherwise designed to be aesthetically pleasing and/or unobtrusive to the eye.

According to an alternate exemplary embodiment, a cleanser assembly for a sanitary fixture having a deck, a bowl, and a compartment defined in the deck in fluid communication with a waterway leading into the bowl, includes a housing mountable onto the deck over the compartment. The housing is configured to receive a reusable or disposable cartridge containing the cleaning product for insertion into the compartment such that the cleaning product is introduced into the waterway and then delivered to the bowl.

Still other objects and advantages of the present invention will in part be obvious and will in part be apparent from the specification, and the scope of the invention will be indicated in the claims.

The present invention accordingly comprises the features of construction, combinations of elements, and arrangement of parts, all as exemplified in the constructions herein set forth.

BRIEF DESCRIPTION OF THE DRAWINGS

For a fuller understanding of the inventive embodiments, reference is had to the following description taken in connection with the accompanying drawings in which:

FIGS. 14A and 14B show perspective and side elevation views of another compartment enclosure and a seat/cover mounted to a sanitary fixture with a hinge that includes arms and a pivot, in accordance with various embodiments of the present invention;

FIG. 17 is a cross-sectional view of a compartment enclosure housing a reservoir, in accordance with various embodiments of the present invention;

FIG. 18 shows a cross-sectional view of a compartment enclosure housing another reservoir, in accordance with various embodiments of the present invention;

FIGS. 21A and 21B show perspective and cross-sectional views of a sanitaryware cleaning system, in accordance with various embodiments of the present invention;

DETAILED DESCRIPTION OF THE PREFERRED EMBODIMENTS

Figure 1:
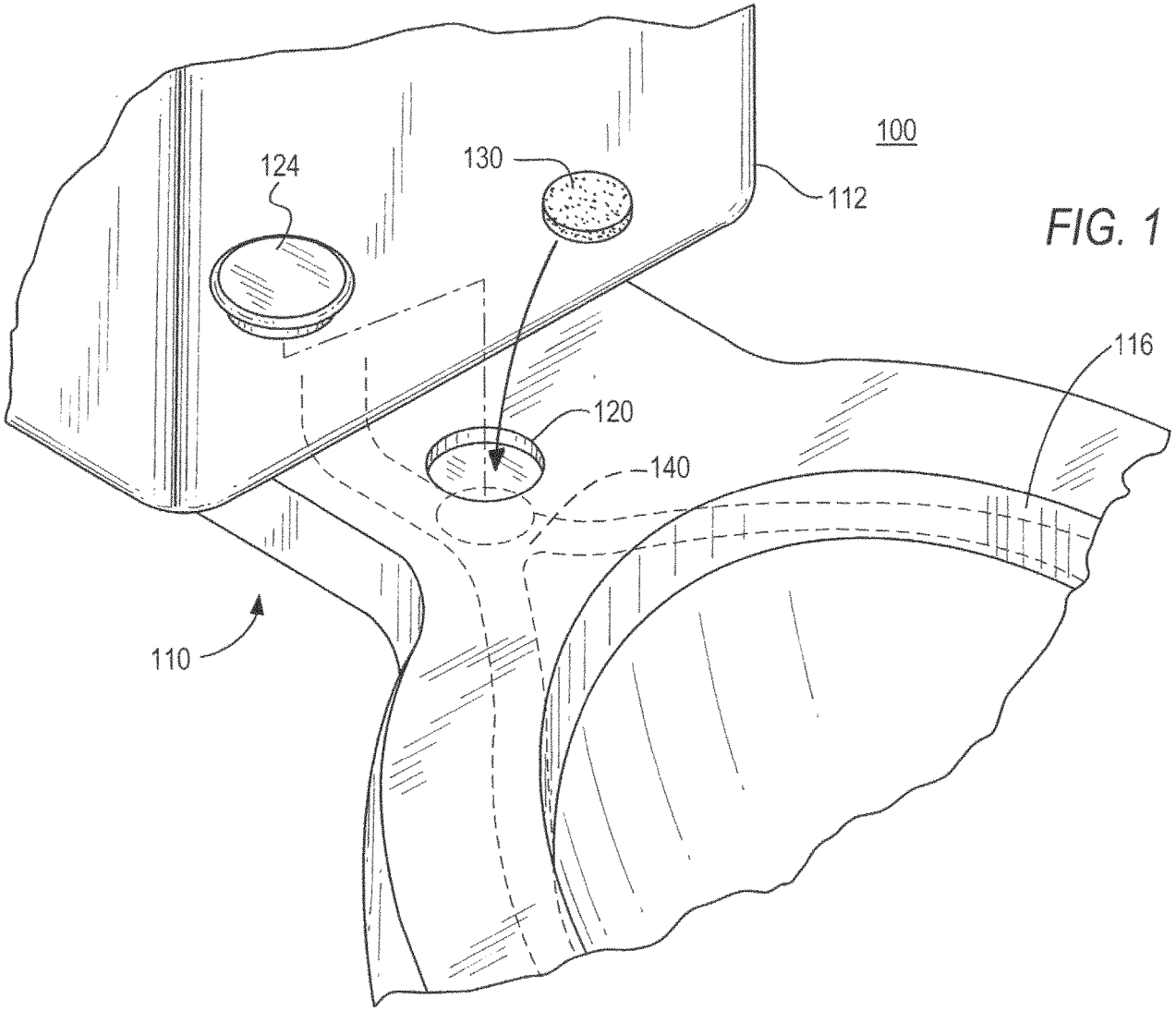
FIG. 1 shows a perspective view of a sanitaryware cleaning system, in accordance with various embodiments of the present invention.

FIG. 1 shows a perspective view of sanitaryware cleaning system 100, in accordance with various embodiments of the present invention. System 100 includes sanitary fixture 110, in this case, a toilet, having tank 112, deck 114, and bowl 116. While the sanitary fixture shown in FIG. 1 is a toilet, it should be appreciated that embodiments of the present invention have application in other types of sanitary fixtures, such as bidets, for example.

Sanitary fixture 110 can include compartment 120 for receiving and/or housing cleaning product 130, which may be used to clean, disinfect, and/or deodorize sanitary fixture 110. As shown in FIG. 1, cleaning product 130 may include one or more cleaning agents formed into a water-soluble solid product, such as a tablet, for example, that dissolves when contacted with water. It should be understood, however, that in other embodiments, cleaning agents may be incorporated into a liquid cleaning product.

During operation of sanitary fixture 110, a measured amount of water can flow past cleaning product 130, dissolving a portion of cleaning product 130 and injecting the cleaning agents into bowl 116. Any suitable cleaning product known in the art that fits within compartment 120 may be used with the embodiments described herein to introduce new cleaning agents into bowl 116 each time sanitary fixture 110 is operated or with some other frequency.

Compartment 120 may be sealed from the outside environment with cap 124. Cap 124 can provide a water-tight or water-resistant seal with compartment 120 to prevent leaks or spray into or out of compartment 120. O-rings 126*a* and 126*b* (shown in FIG. 4) may facilitate the desired water-tight fit. Cap 124 may be removably coupled to compartment 120 using any suitable coupling features, such as one or more threads, clips, clasps, or latches, for example. Cap 124 may also form a press-fit coupling with the edges of compartment 120. In some embodiments, cap 124 may use a child proof design, such as a squeeze-and-turn, push-down-and-turn, or a push-tab-and-turn threaded coupling. Child proofing compartment 120 may help to prevent children or pets from accessing tablet 130, which can contain potentially harmful ingredients. Cap 124 may be formed from any suitable plastic, metal, or composite material, or cap 124 may be formed from a ceramic material similar or identical to the ceramic material used to form the body of sanitary fixture 110.

Compartment 120 may be positioned at any location that provides access to the flush water channel(s) downstream of the flush valve and upstream of the rim outlet port(s). To minimize the potential for leaks, a preferable position is on/under deck 114 of sanitary fixture 110. That is, compartment 120 may include a hole in deck 114 that extends from its top surface and into waterway 140 below. The hole may be formed using any process suitable for working with sanitary fixtures, which are typically made of porcelain. For example, the hole may be formed when the sanitary fixture is molded or after the fixture is molded, and before or after the fixture is glazed and fired, using a punching or drilling process. Compartment 120 may be located at any location on and under deck 114 that provides easy access from the top for replacing tablet 130 and access to the flow of water between tank 112 and bowl 116.

In particular, compartment 120 may be located at least partially within waterway 140, which can run between tank 112 and one or more outlet ports near the rim of bowl 116. Depending on the particular construction of sanitary fixture 110, the number of rim outlet ports (e.g., 1, 5, 10, 20, etc.) provided near the rim may vary. Water flowing through waterway 140 and past compartment 120 may enter bowl 116 via some or all of the rim outlet ports provided.

Figure 2B:
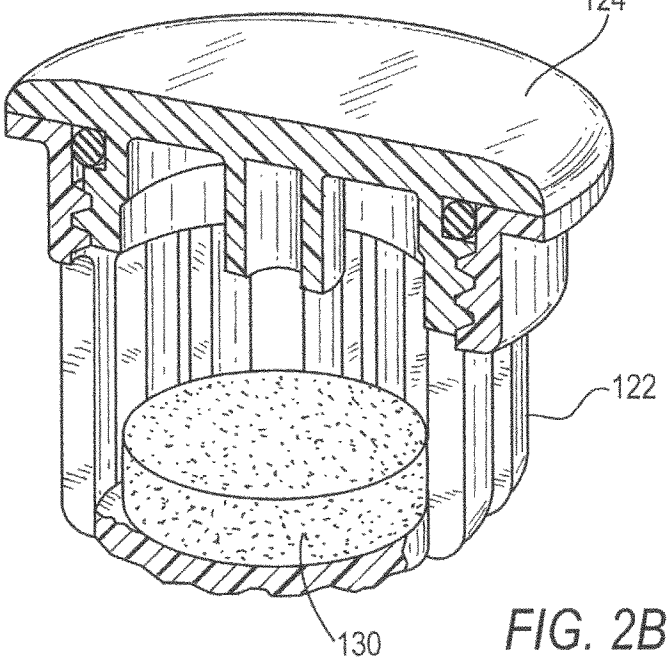
FIGS. 2A and 2B show perspective and cutaway views, respectively, of a basket, cap, and cleaning product, in accordance with various embodiments of the present invention.
Figure 2A:
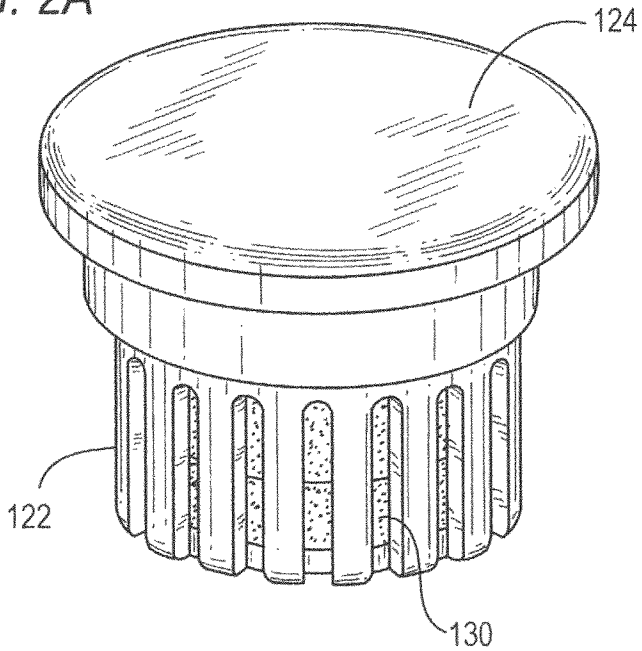

FIGS. 2A and 2B show perspective and cutaway views, respectively, of basket 122, cap 124, and cleaning product 130 in accordance with various embodiments. Basket 122 can be situated within compartment 120 and may include one or more slots, perforations, or orifices (generally referred to herein as apertures) to allow water to flow past cleaning product 130 while maintaining the cleaning product within the basket. Although cap 124 is depicted in FIGS. 2A and 2B as clipping onto grooved features formed on the internal surface of basket 122, cap 124 may be coupled to basket 122 and/or the compartment in which basket is housed using the various alternative methods described above as well as using other methods known in the art.

Figure 3:
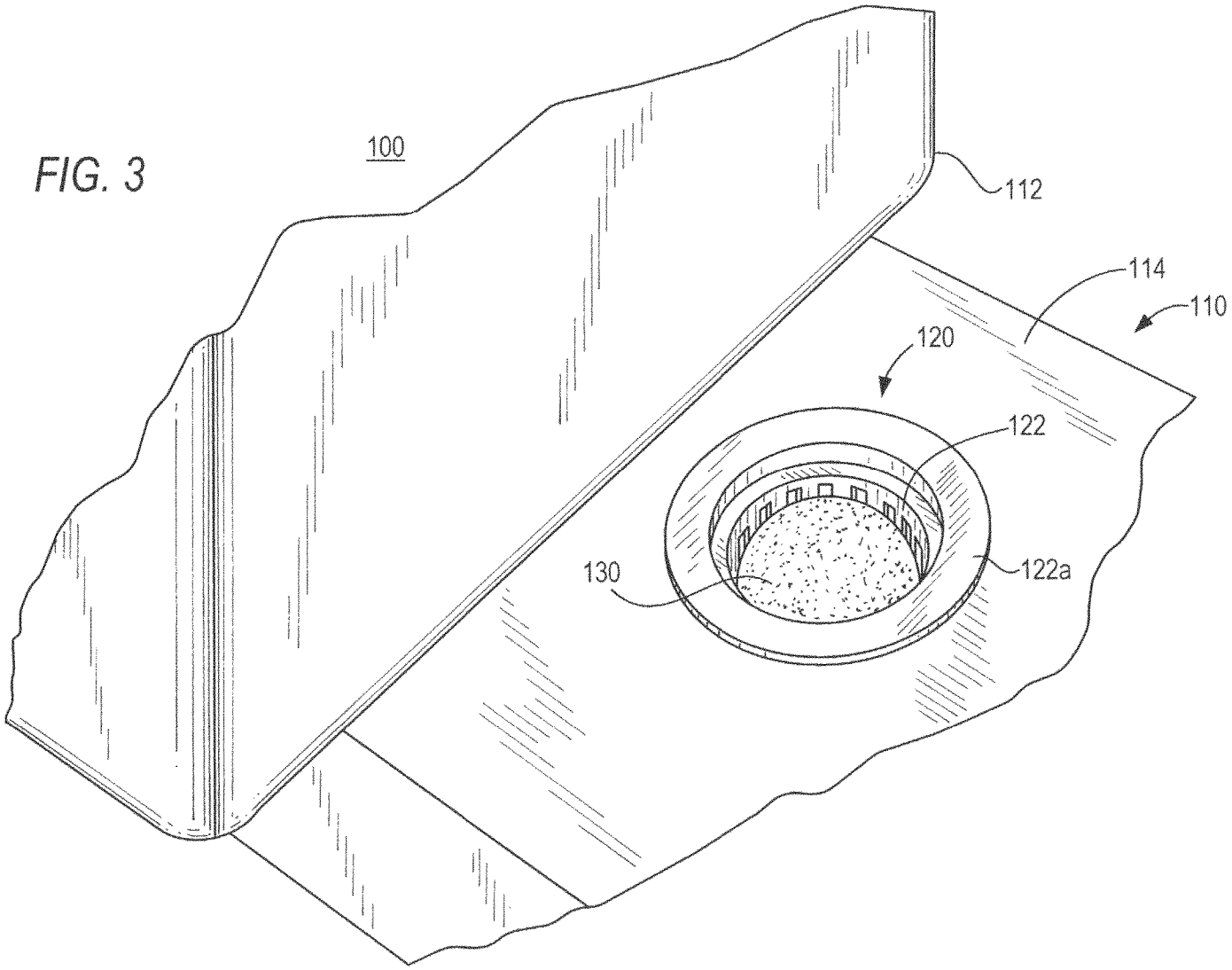
FIG. 3 shows a perspective view of sanitaryware cleaning system with a basket placed in a compartment, in accordance with various embodiments of the invention.

FIG. 3 shows a perspective view of sanitaryware cleaning system 100 with basket 122 placed in compartment 120, in accordance with various embodiments of the invention. According to some embodiments, basket 122 may be placed in compartment 120 to maintain cleaning product 130 at least partially in waterway 140 between tank 112 and bowl 116. Basket 122 can include one or more slots, perforations, or orifices to allow water to flow from tank 112, past tablet 130, and into bowl 116. Basket 122 may be formed from any suitable plastic, metal, or composite material. However, it may be advantageous to choose a material that is resistant to degradation with prolonged exposure to water and the chemicals bound up in cleaning product 130 to prolong its life and to avoid the need to replace basket 122 periodically. Basket 122 may be removable from compartment 120 if desired to clean the basket, replace the basket, access the waterway, and/or to facilitate replacement of tablet 130.

Figure 4:
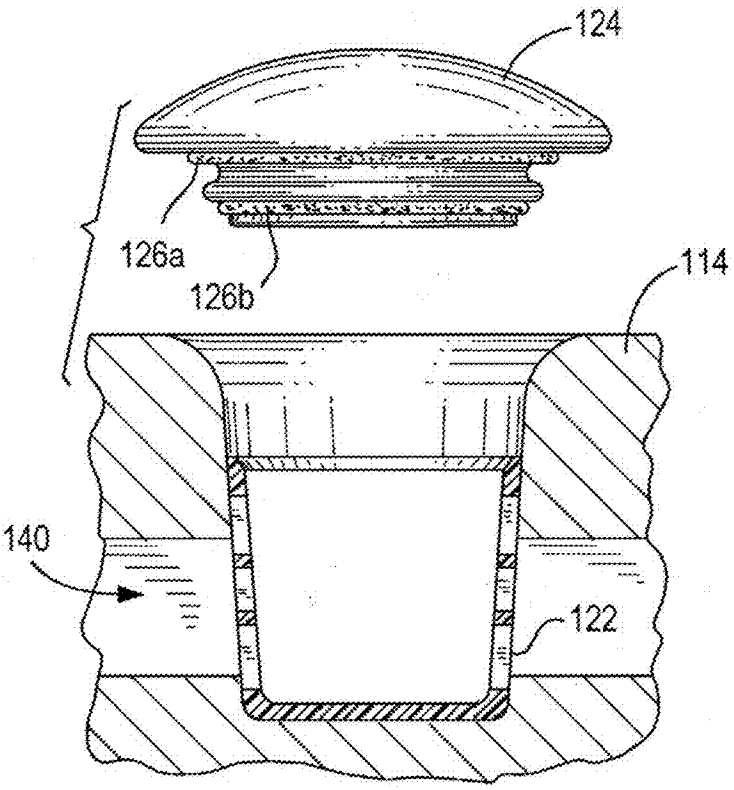
FIG. 4 shows a cross-sectional view of a basket situated in a compartment, in accordance with various embodiments of the invention.

FIG. 4 shows a cross-sectional view of basket 122 situated in compartment 120, in accordance with various embodiments of the invention. As depicted in FIG. 4, basket 122 can extend fully through waterway 140 to situate cleaning product 130 within the flow of water between tank 112 and bowl 116. In some embodiments, however, basket 122 may only extend partially into waterway 140. Generally speaking, the higher the surface area of cleaning product 130 contacted by fluid in waterway 140, the higher the volume of cleaning agents discharged into bowl 116. Thus, the rate at which cleaning agents are injected into bowl 116 may be varied by varying how far basket 122 extends into waterway 140, among other variables, such as the size of the slots, perforations, or orifices of basket 122.

As depicted in FIG. 4, basket 122 may sit fully within compartment 120. Alternatively, as depicted in FIG. 3, basket 122 may include lip 122*a* (integrally formed with basket 122 or otherwise coupled thereto) configured to rest atop or just below the surface of deck 114.

Figure 5:
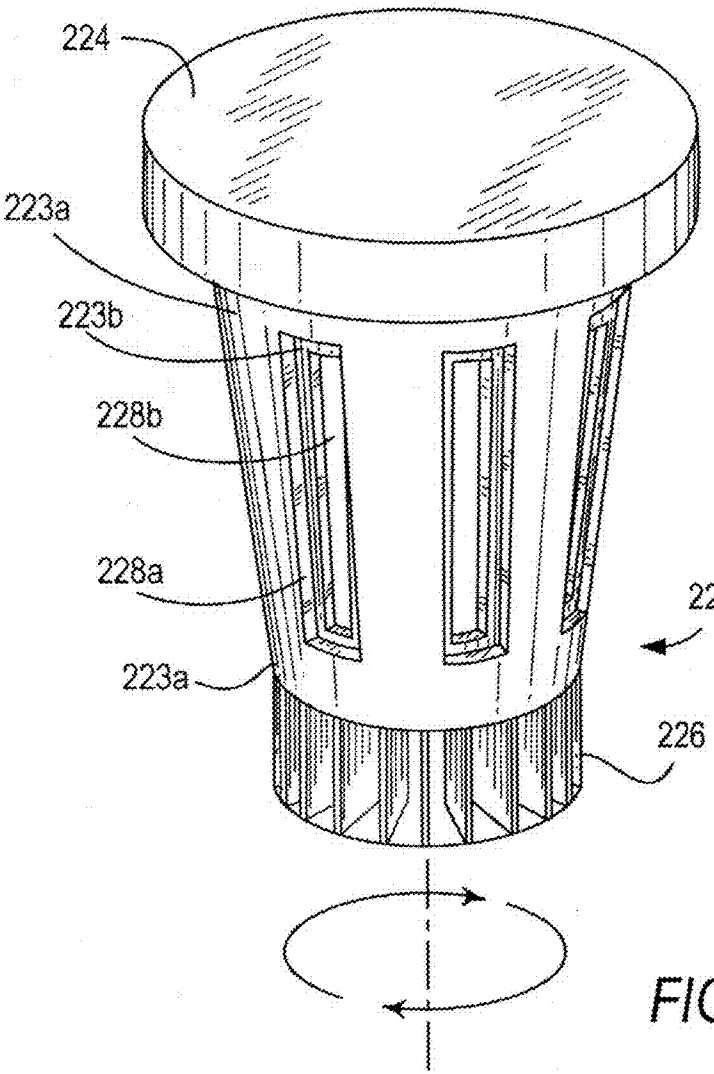
FIG. 5 shows a perspective view of another basket, in accordance with various embodiments of the invention.

FIG. 5 shows a perspective view of basket 222, in accordance with various embodiments of the invention. Basket 222 may be configured to inject cleaning agents into the bowl periodically (e.g., every 3, 5, or 10 flushes) as opposed to basket 122, which results in injection of cleaning agents every flush. In order to reduce the frequency at which cleaning agents are injected into the bowl, basket 222 can include outer shell 223*a* having slots 228*a* and inner shell 223*b* (visible through slots 228*a*) having slots 228*b*. When slots 228*a* and 228*b* are aligned, water flowing past basket 222 through the waterway (e.g., waterway 140) can contact a cleaning product (e.g., cleaning product 130) placed within the basket and inject cleaning agents into the bowl.

In order to periodically align slots 228*a* and 228*b*, basket 222 can include waterwheel 226, which may be coupled to one or the other of outer shell 223*a* and inner shell 223*b*. When fluid flows through the waterway past basket 222, waterwheel 226, and by extension either outer shell 223*a* or inner shell 223*b*, can rotate a certain amount as shown by the arrows depicted in FIG. 5. By rotating one of outer shell

223*a* and inner shell 223*b* with respect to the other, slots 228*a* and 228*b* can be periodically aligned (opened) and misaligned (closed) in order to provide a periodic injection of cleaning agents. The periodicity of injection may be varied by altering the distance waterwheel 226 rotates each flush as well as by altering the relative spacing between slots 228*a* and between slots 228*b*. The non-rotating shell, that is, the shell not coupled to waterwheel 226, may be coupled (e.g., via a press fit with or without O-rings, with a threaded connection, or with one or more clips or fasteners) to cap 224 to rotatably fix that shell in compartment 120.

Figure 6A:
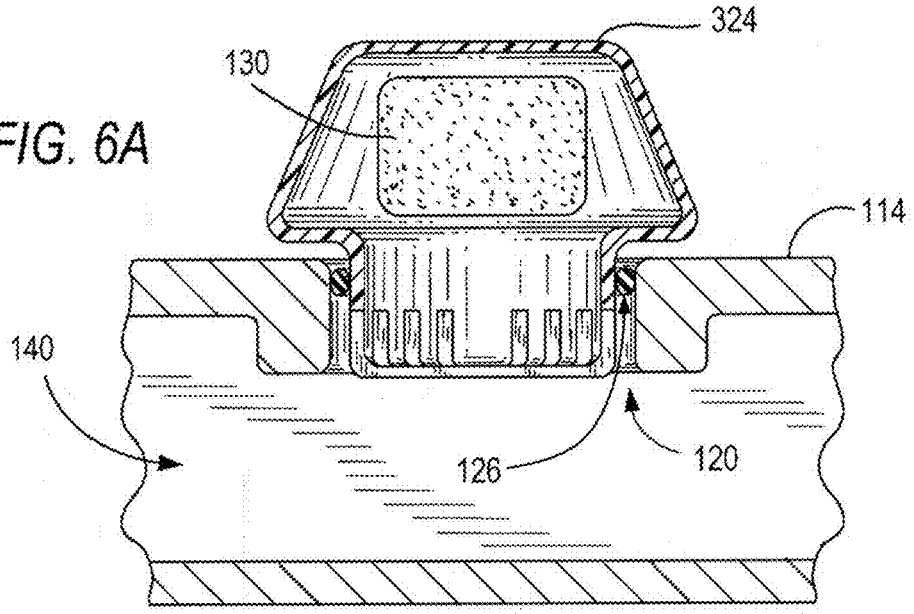
FIGS. 6A and 6B show a cross-sectional view of cleaning pucks situated in a compartment, in accordance with various embodiments of the invention.

FIG. 6A shows a cross-sectional view of cleaning puck 324 situated in compartment 120, in accordance with various embodiments of the invention. Cleaning puck 324 may combine aspects of a cap (e.g., cap 124 or 224) and a basket (e.g., basket 122 or 222) in a single component. Accordingly, cleaning puck 324 can include a hollow cavity to house cleaning product 130 and can be placed within compartment 120 of sanitary fixture 110. O-ring 126 may be provided around a perimeter of cleaning puck 324 configured to reside within compartment 120 in order to seal compartment 120 off from the environment outside of sanitary fixture 110. Cleaning puck 324 may be removably coupled to edges of compartment 120 using, for example, a press-fit or threaded coupling.

When fluid flows through waterway 140, some amount of fluid can enter into the hollow cavity of cleaning puck 324 to contact cleaning product 130 and carry cleaning agents into bowl 116. In some embodiments, cleaning puck 324 may be a consumable unit that is replaceable when cleaning product 130 is exhausted. In other embodiments, cleaning puck 324 may be designed to receive a new cleaning product when cleaning product 130 is exhausted.

Figure 6B:
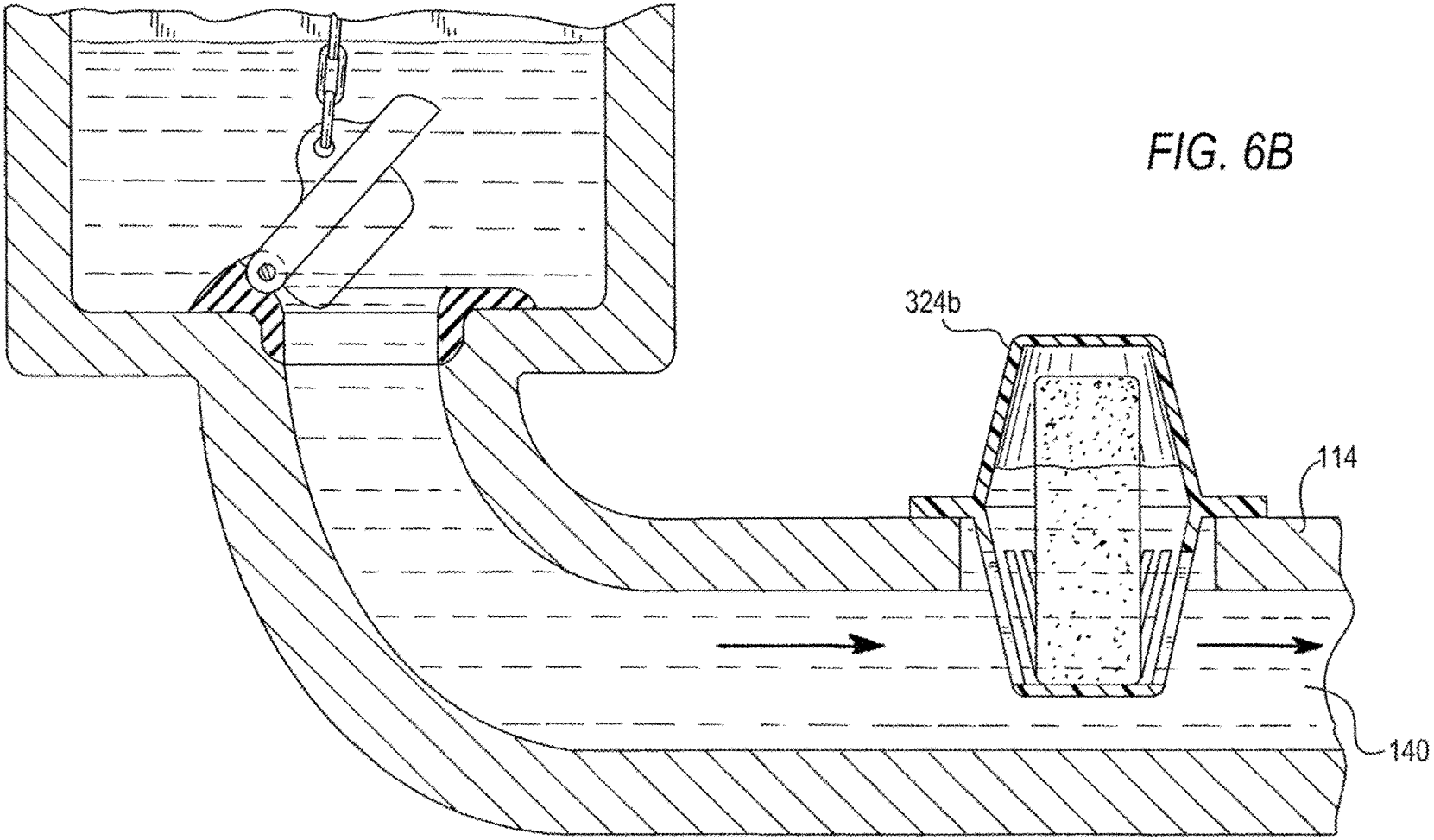

FIG. 6B shows a schematic cross-sectional view of an alternative cleaning puck 324*b*, in accordance with various embodiments of the present invention. Like cleaning puck 324, cleaning puck 324*b* can be provided as a single component that includes a hollow cavity to house cleaning product 130, which in this case is cylindrically-shaped and extends into waterway 140. As water erodes cleaning material 130, the force of gravity can cause the material to remain in waterway 140. Further, in contrast to cleaning puck 324, the section of cleaning puck 324*b* that extends above deck 114 can be sized and shaped to retain air compressed in waterway 140 when sanitary fixture 110 is flushed. This compressed-air chamber can help to ensure that water flowing down waterway 140 suitably interacts with cleaning product 130.

Figure 7:
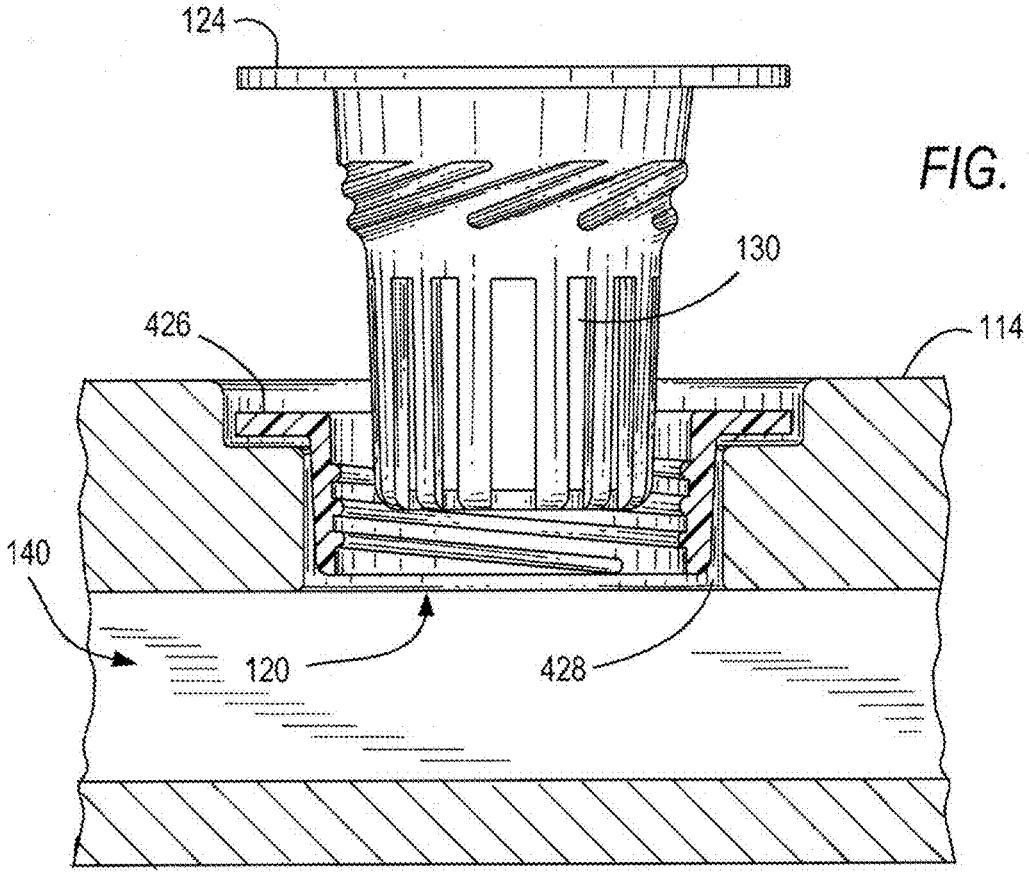
FIGS. 7 and 8 show cross-sectional and exploded views of a cleaning cup for use in sanitary fixture, in accordance with various embodiments of the invention.
Figure 8:
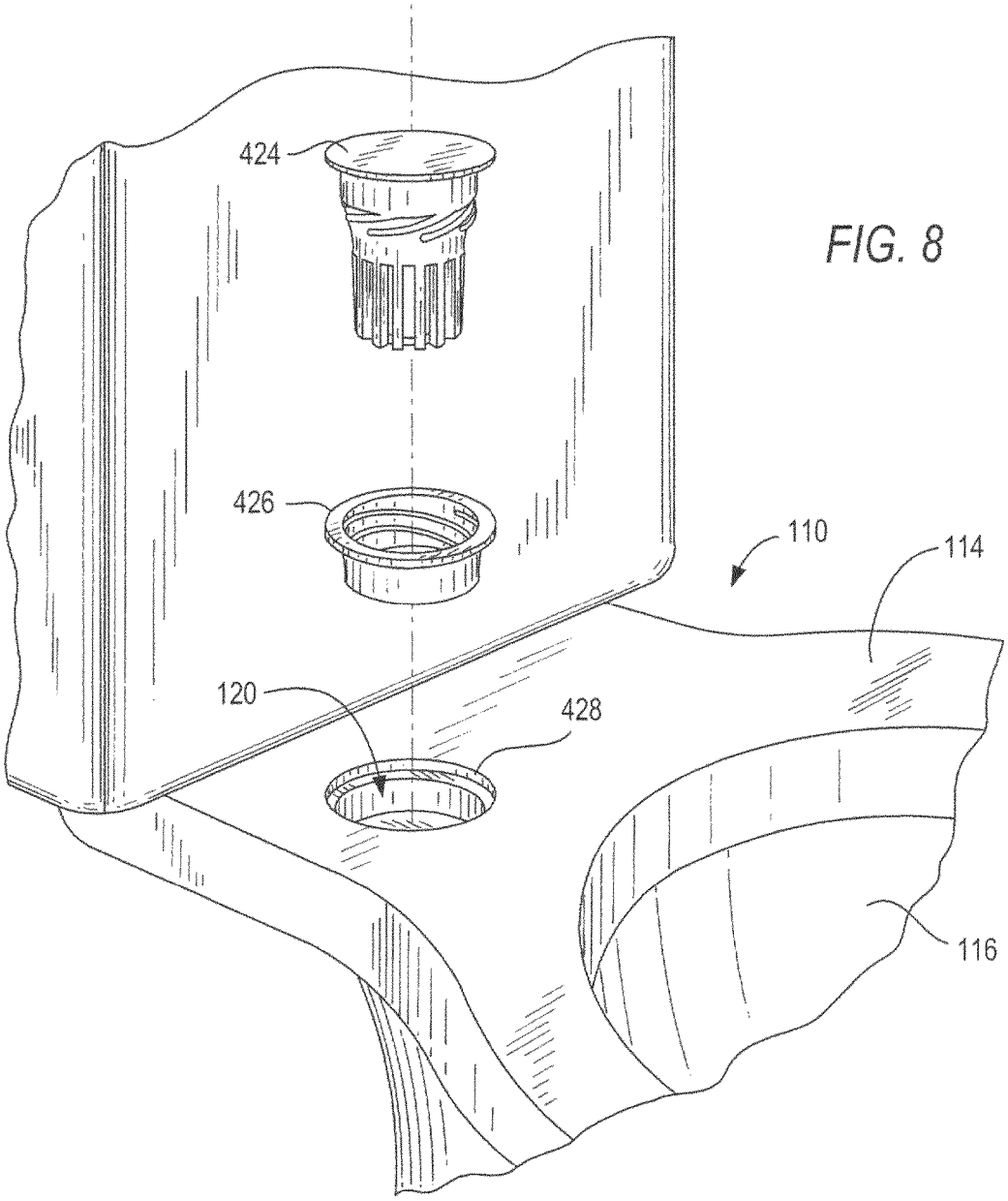

FIGS. 7 and 8 show cross-sectional and exploded views, respectively, of a cleaning cup 424 for use in sanitary fixture 110, in accordance with various embodiments of the invention. Cleaning cup 424, like cleaning puck 324 can combine aspects of a cap (e.g., cap 124 or 224) and a basket (e.g., basket 122 or 222) in a single component. Cleaning cup 424 may be placed directly into compartment 120 of sanitary fixture 110 and can seal the compartment off from the environment outside sanitary fixture 110 using a press-fit or threaded coupling with or without an O-ring. Cleaning cup 424 can include a hollow cavity to retain cleaning component 130 with slots permitting fluid communication into the hollow cavity such that when water flows through waterway 140, water contacts cleaning component 130 and carries cleaning agents into bowl 116.

In some embodiments, cleaning cup 424 may be configured to mate with sleeve 426, which may be formed from any suitable material, such as a plastic, metal, composite, or ceramic material. Sleeve 426 may include an interior annular perimeter with one or more coupling components formed thereon (e.g., threads complementary to threads formed on an outer annular perimeter of cleaning cup 424. In these embodiments, cleaning cup 424 may be provided with one or more sealing elements (e.g., O-rings) to seal off compartment 120. In other embodiments, sleeve 426 may be received within a sealing sleeve 428 designed to fit closely against the contours of the outer surfaces of compartment 120. Sealing sleeve 428 may be formed from a resilient material, such as silicone or rubber, for example.

Figure 9:
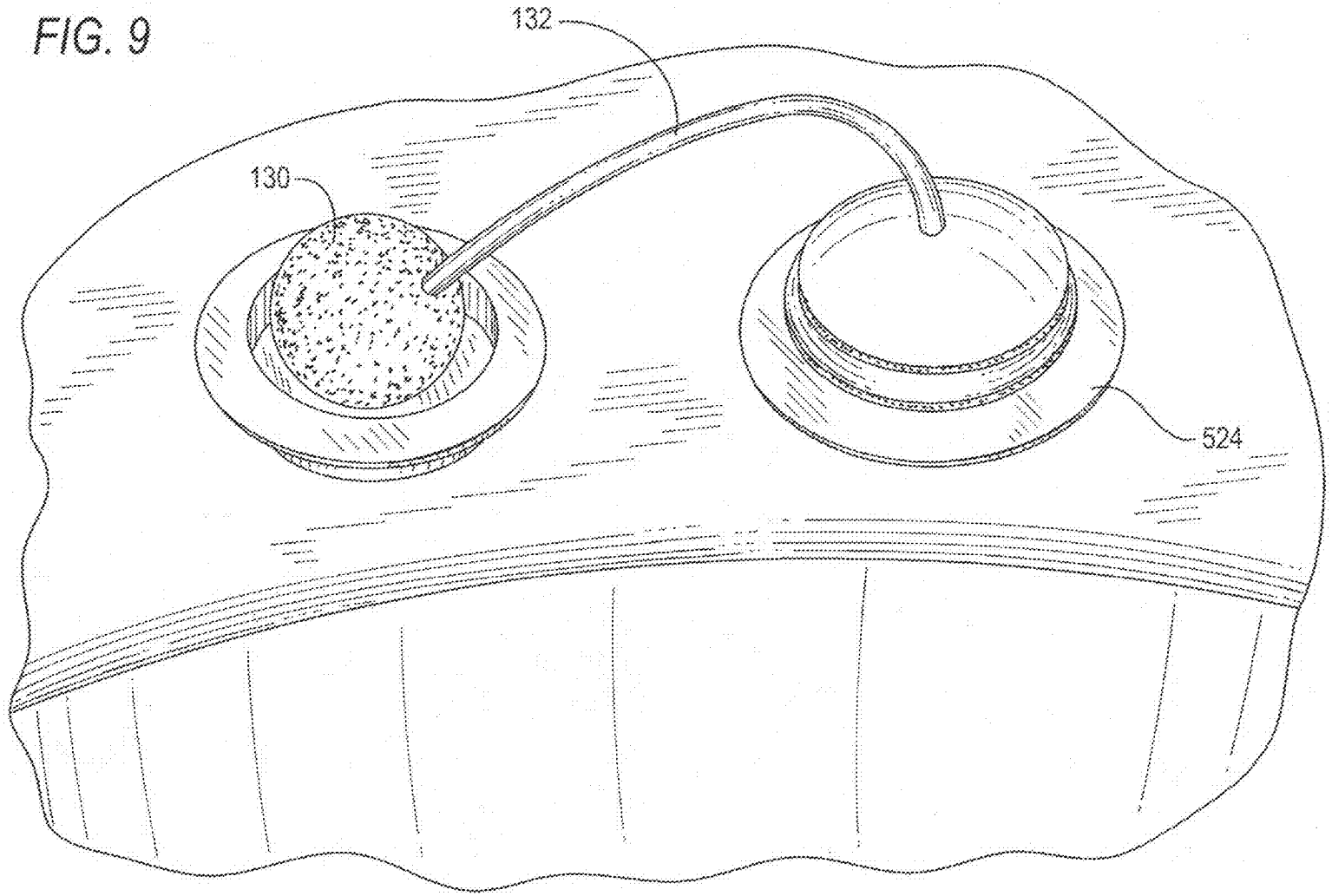
FIG. 9 shows a perspective view of a cleaning product tethered to a cap, in accordance with various embodiments.

FIG. 9 shows a perspective view of cleaning product 130 tethered to cap 524, in accordance with various embodiments. In these embodiments, cleaning product 130 may be provided with tether 132, which may be removably coupled to a feature of cap 524 (e.g., using a press-fit coupling, an adhesive, or the like). Cleaning product 130 may then be placed within compartment 120 of sanitary fixture 110. Tether 132 may permit cleaning product 130 to move freely in waterway 140 between tank 112 and the rim outlet ports to facilitate dissolution of the cleaning agent. The length of tether 132 may be optimized to prevent cleaning product 130 from having prolonged contact with any surfaces of sanitary fixture 110. Cap 524 may be removably coupled to a feature of compartment 120 as described above.

In some embodiments, one or more elements of cleaning product 130, cap 524, and tether 132 may be part of a single consumable cleaning agent package, which could eliminate the need for ensuring long-term chemical compatibility of the elements, and could provide a less expensive and more reliable system.

The efficacy of a particular sanitaryware cleaning system may depend on many factors, including how much cleaning material is dispensed into the bowl, where the cleaning material is dispensed, and how much of the cleaning material is jetted directly through the trapway and out of the bowl without contacting a significant portion of the surface to be cleaned. These factors may all be influenced by the particular designs of the sanitaryware system. Cleaning sanitary fixture 110 using cleaning products dispensed through the rim outlets may be particularly effective when used in conjunction with a system that discharges all of the cleaning agents through the rim outlets.

Figure 10:
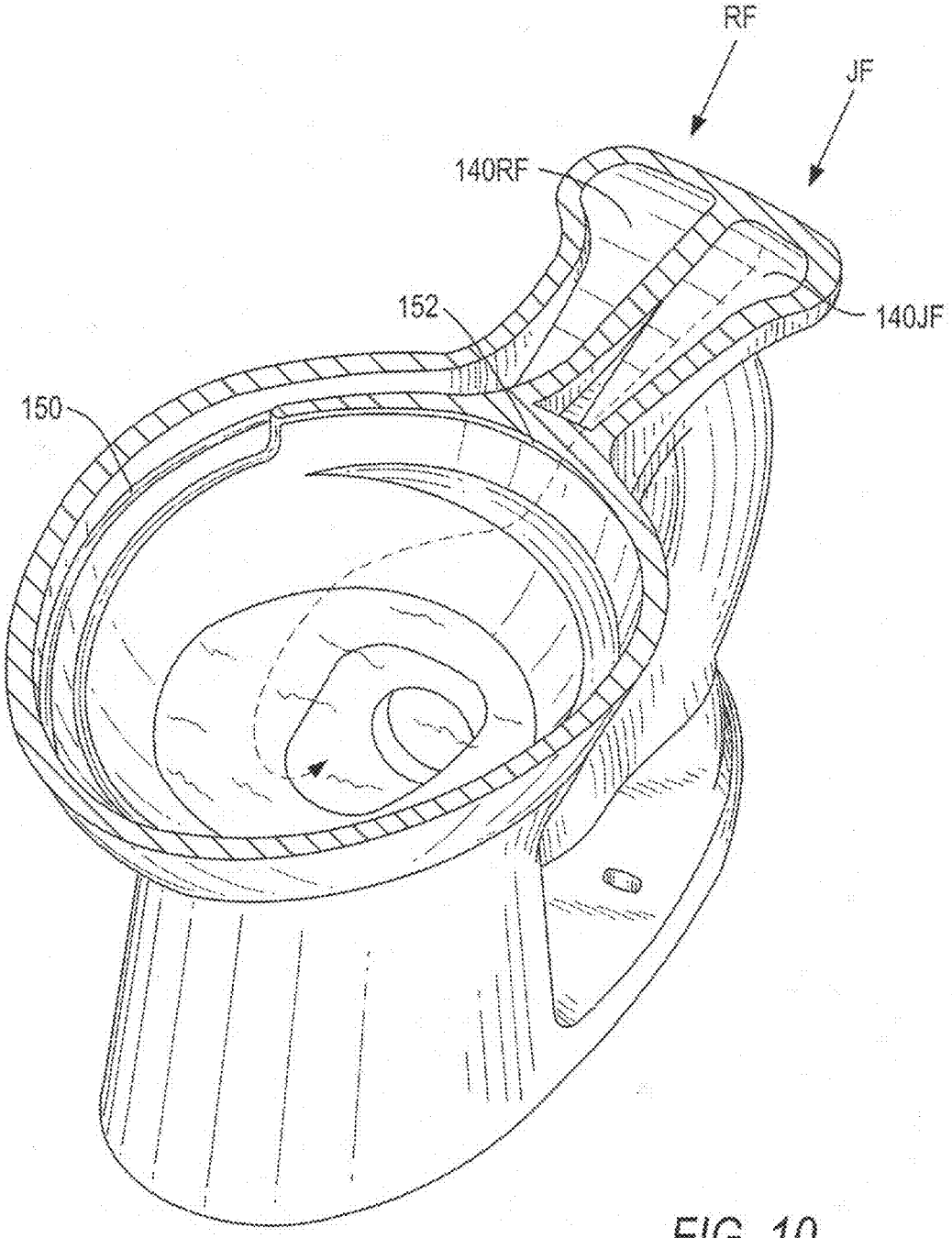
FIG. 10 shows a perspective, cut-away view of a primed siphonic flush toilet, in accordance with various embodiments of the invention.

For instance, a primed siphonic flush toilet with isolated rim and jet channels may be particularly well suited for use with the embodiments disclosed herein because the isolated channels allow the cleaning systems described herein to be positioned in the rim channel. In particular, because compartment 120 may be positioned within the rim channel to allow 100% of the dissolved cleaning agents to flow through the rim outlet ports, this construction can ensure maximum utilization of the cleaning agent by avoiding its direct injection into the entrance of the trapway through the jet outlet port. Accordingly, a primed siphonic flush toilet construction can ensure optimal bulk removal waste from the toilet system in combination with optimal efficacy of the cleaning systems described herein. A perspective, cut-away view of a primed siphonic flush toilet in accordance with some embodiments is shown in FIG. 10. According to embodiments of the present invention, compartment 120 may be located within rim flush (RF) channel 140RF such that the cleaning agents are not directed via jet flush (JF) channel 140JF.

RF channel 140RF can inject cleaning agents into bowl 116 via rim outlet port 150 while JF channel 140JF can direct water through bowl outlet port 152. In particular, FIG. 10 depicts water, including dissolved cleaning agents, entering bowl 116 via rim outlet port 150. As the clean water enters bowl 116, the cleaning agents can clean, disinfect, and deodorize most or all of the surface area of bowl 116. As shown in FIG. 10, after flushing is complete, a volume of clean water, including dissolved cleaning agents, remains in bowl 116, providing long-lasting disinfecting and deodorizing effects. While FIG. 10 depicts a primed siphonic flush toilet, isolated rim and jet chambers may be employed in other types of sanitaryware fixtures.

Although non-jetted bowls typically provide lower flushing power and efficiency than other designs, non-jetted bowls may also be well suited for the use with the embodiments disclosed herein since all of the dissolved cleaning fluid would be distributed around the rim of the bowl, achieving greater cleaning efficacy.

Furthermore, while the embodiments described herein may be applied to typical jetted bowls, the efficacy and efficiency of the cleaning agent might be somewhat diminished due to the significant portion that would exit the jet outlet and be directed directly towards the trapway entrance and out of the bowl. In fact, using "direct-jetted" construction, as much as 75% of the cleaning agent may be directed to the jet outlet port, much of which is then siphoned directly up the trap and out of the toilet outlet resulting in material waste, diminished efficacy, and frequent tablet replacement.

The embodiments disclosed with respect to FIGS. 1-10 each provides access to waterway 140 of sanitary fixture 110 via compartment 120 directly accessible from deck 114. Alternative embodiments, in which access to waterway 140 is contained within a compartment enclosure, are disclosed below with respect to FIGS. 11-15. A compartment enclosure can serve to seal off waterway 140 from the environment outside of sanitary fixture 110, conceal the cleaning product and the various containing components disclosed above from a user of the fixture, and/or provide a mounting point for seat/cover 118. Compartment enclosures may be used with any of the embodiments disclosed above.

Figure 11:
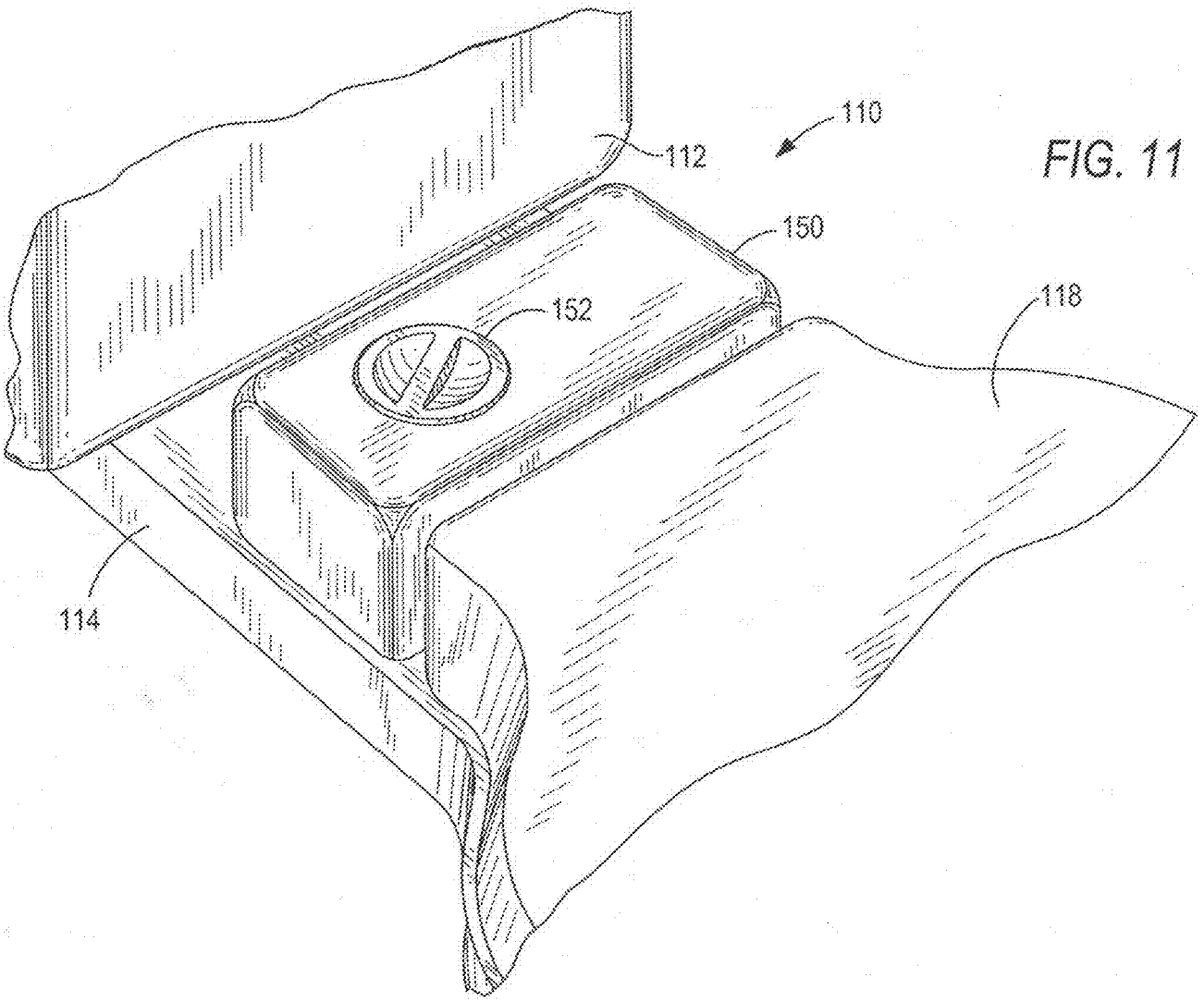
FIG. 11 shows a perspective view of a sanitary fixture provided with an enclosure for the compartment in accordance with embodiments of the present invention.

FIG. 11 shows a perspective view of sanitary fixture 110 provided with compartment enclosure 150. Enclosure 150 can include an aperture, covered by cap 152, which can provide access to compartment 120 for purposes of changing cleaning product 130. In some embodiments, cap 152 may simply cover a hollow cavity within enclosure 150 such that changing or replenishing cleaning product 130 proceeds as described for each of the embodiments described with respect to FIGS. 1-10.

Alternatively, compartment 120 may be understood to extend from waterway 140, through deck 114 and enclosure 150, to the aperture in enclosure 150 sealed off by cap 152. In these embodiments, cap 152 may be functionally similar to cap 124 or 224, cleaning puck 324, or cleaning cup 424. Each of the other components of the above-described embodiments can be lengthened appropriately to traverse the additional height of compartment enclosure 150 such that cleaning product 130 remains in communication with waterway 140 below deck 114.

Figure 12:
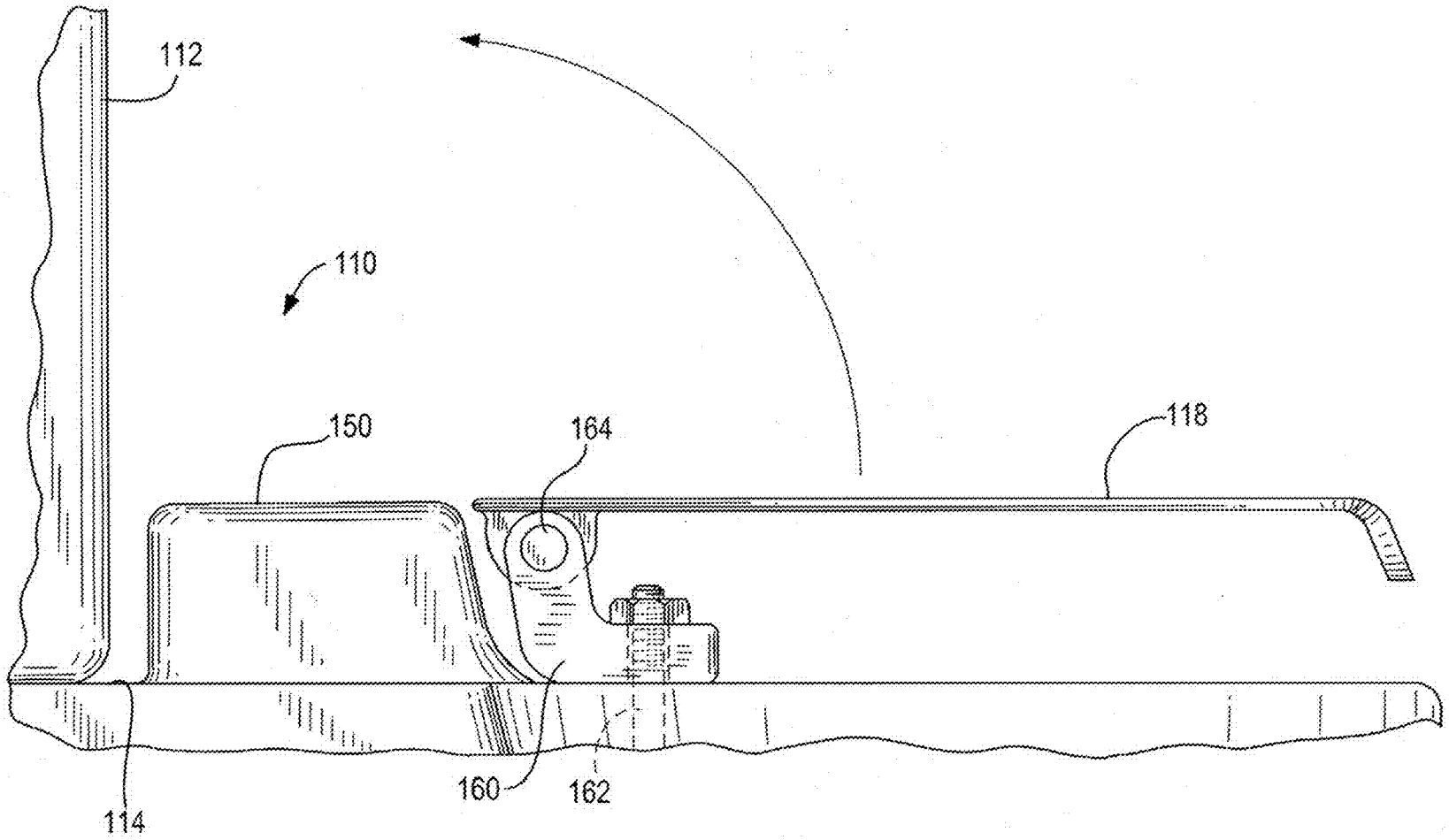
FIG. 12 shows a side elevation view of a sanitary fixture including a seat/cover mounted thereto via an L-bracket, in accordance with various embodiments of the present invention.

FIG. 12 is a side elevational view of seat/cover 118 mounted to sanitary fixture 110 with L-bracket 160, in accordance with various embodiments of the present invention. L-bracket 160 may raise the pivot point of seat/cover 118, as compared with conventional seat hinges, to avoid interference with enclosure 150. L-bracket can be mounted to deck 114 using fastener 162 and can include hinge 164 for rotatably coupling seat/cover 118 to sanitary fixture 110.

Figure 13A:
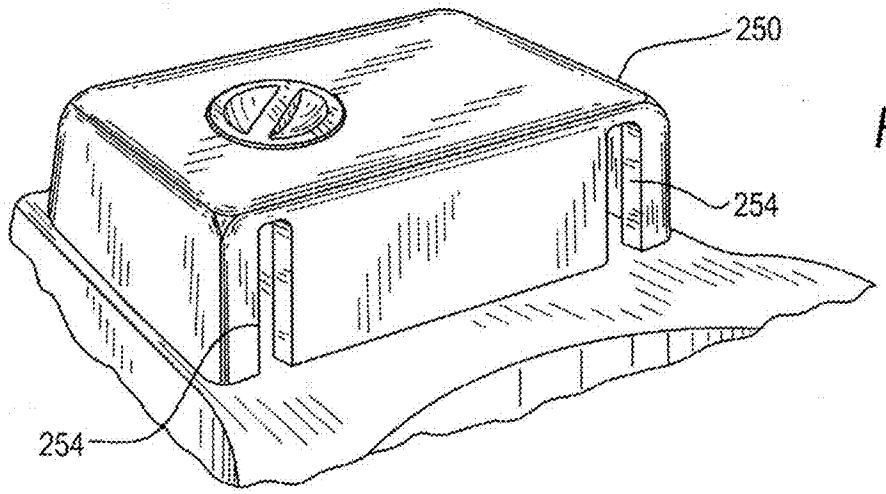
FIGS. 13A and 13B show perspective and side elevation views of a compartment enclosure and a seat/cover mounted to a sanitary fixture with a hinge that includes arms and a pivot, in accordance with various embodiments of the present invention.
Figure 13B:
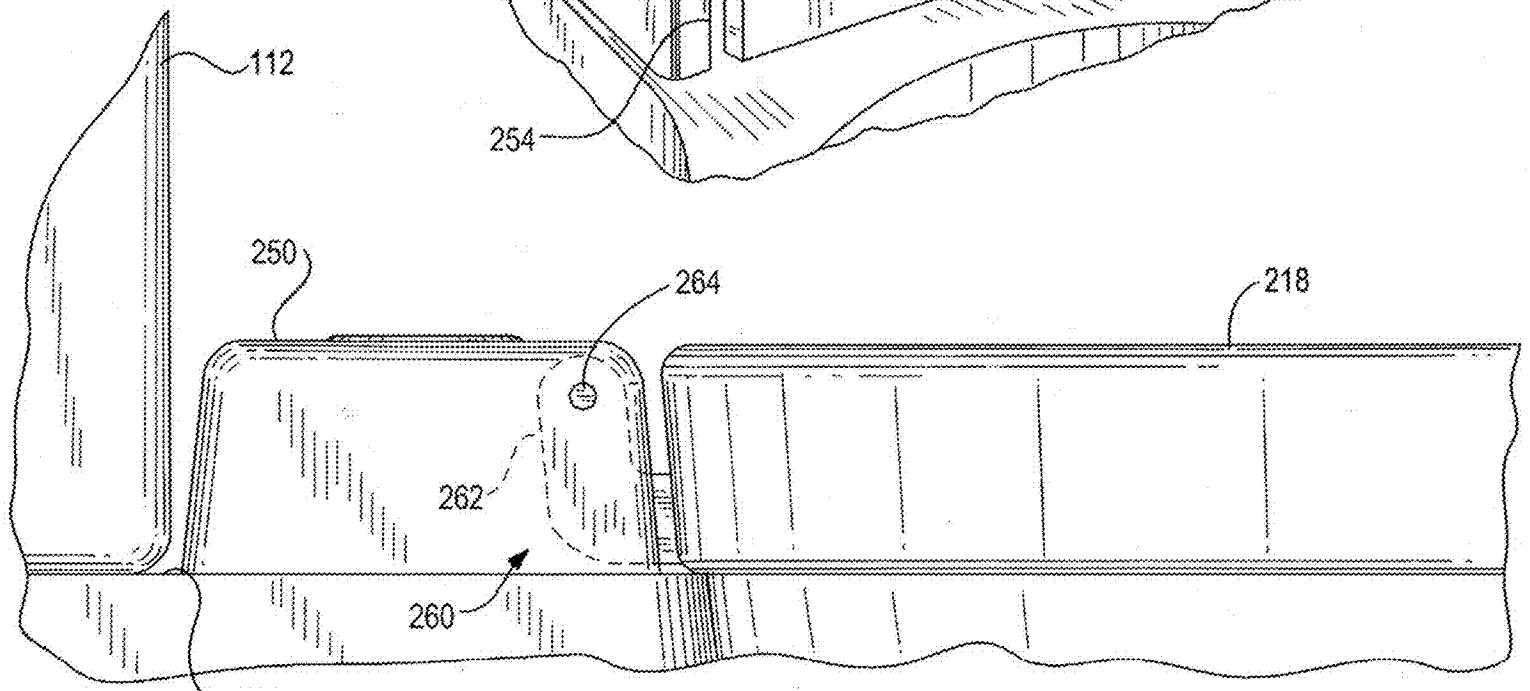

FIGS. 13A and 13B are perspective and side elevational views, respectively, of seat/cover 218 mounted to sanitary fixture 110 with hinge 260 that includes arms 262 and pivot 264. Arms 262 can be curved or L-shaped members extending from an edge of seat/cover 218 and into compartment enclosure 250 to be rotatably coupled to pivot 264. Flapped apertures 254 may be provided in enclosure 250 to receive arms 262 and to prevent visibility into the interior of enclosure 250. The flaps that close flapped apertures 254 may be formed from a resilient material, such as silicone or rubber, for example.

FIGS. 14A and 14B are perspective and side elevational views, respectively, of seat/cover 318 mounted to sanitary fixture 110 with hinge 360 that includes arms 362 and pivot 364. Arms 362 can be removably inserted into sockets 354 of compartment enclosure 350 and rotatably couple to pivot 364 outside of enclosure 350, providing for easy installation and removal of seat/cover 318 for cleaning.

Figure 15A:
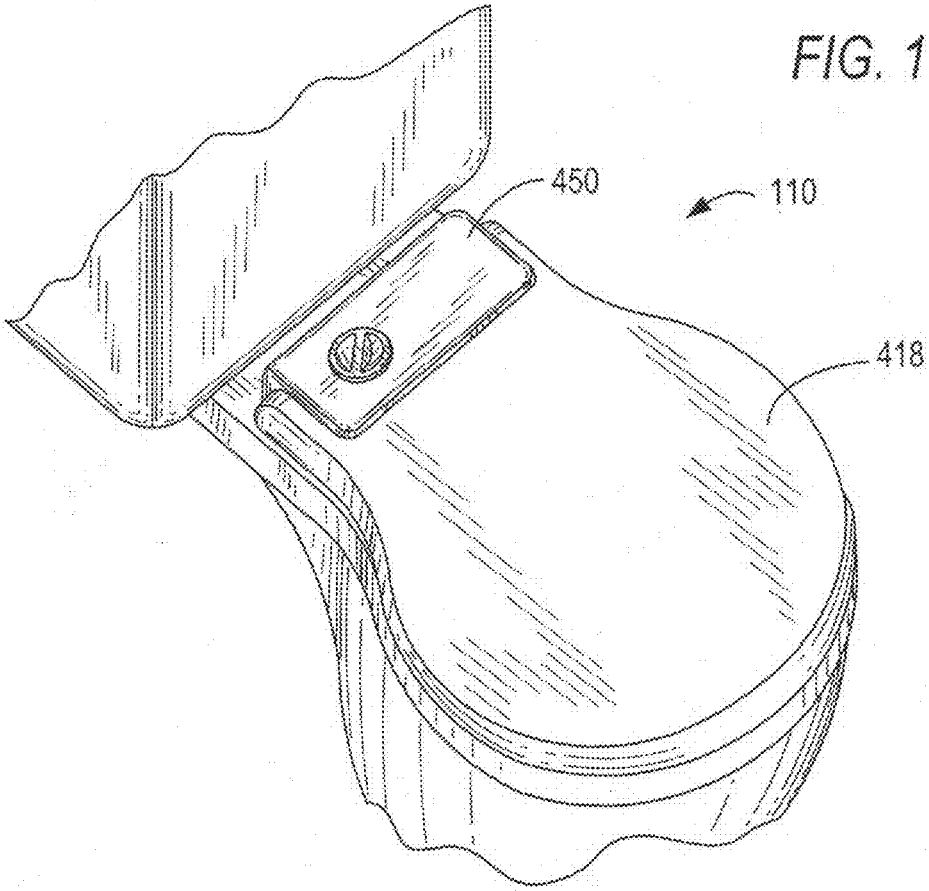
FIGS. 15A and 15B show perspective and cross-sectional views of a seat/cover mounted to a sanitary fixture with a hinge that includes a pivot extending from the compartment enclosure into nested arms of the seat/cover, in accordance with various embodiments of the present invention.
Figure 15B:
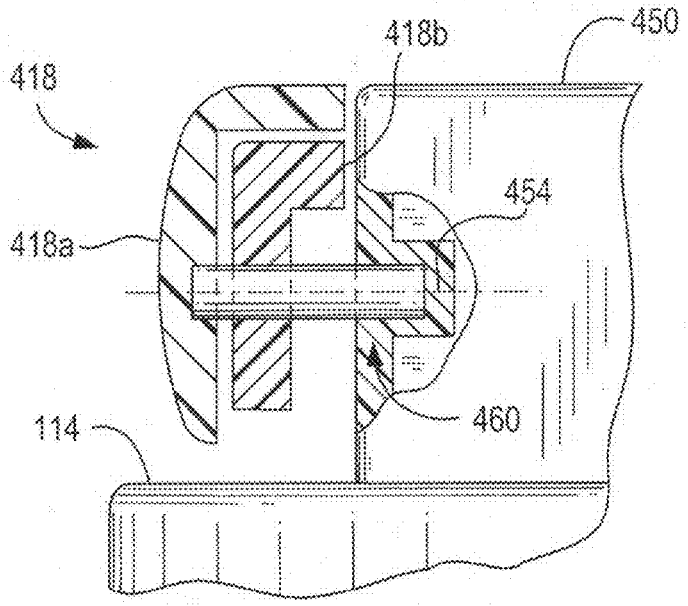

FIGS. 15A and 15B show perspective and partial cross sectional views, respectively, of seat/cover 418 mounted to sanitary fixture 110 with hinge 460 that includes pivot 454 extending from enclosure 450 into nested arms of seat/cover 418. In particular, pivot 454 extends through an aperture in an arm of seat 418*b* extending towards deck 114 and into a recess in an arm of cover 418*a* extending towards deck 114.

As previously noted, cleaning agents for use with the embodiments disclosed herein may be provided in a water-soluble solid product, such as cleaning product 130, or in liquid form. Embodiments of the present invention that utilize liquid cleaning products will be described below with respect to FIGS. 16-24.

Figure 16:
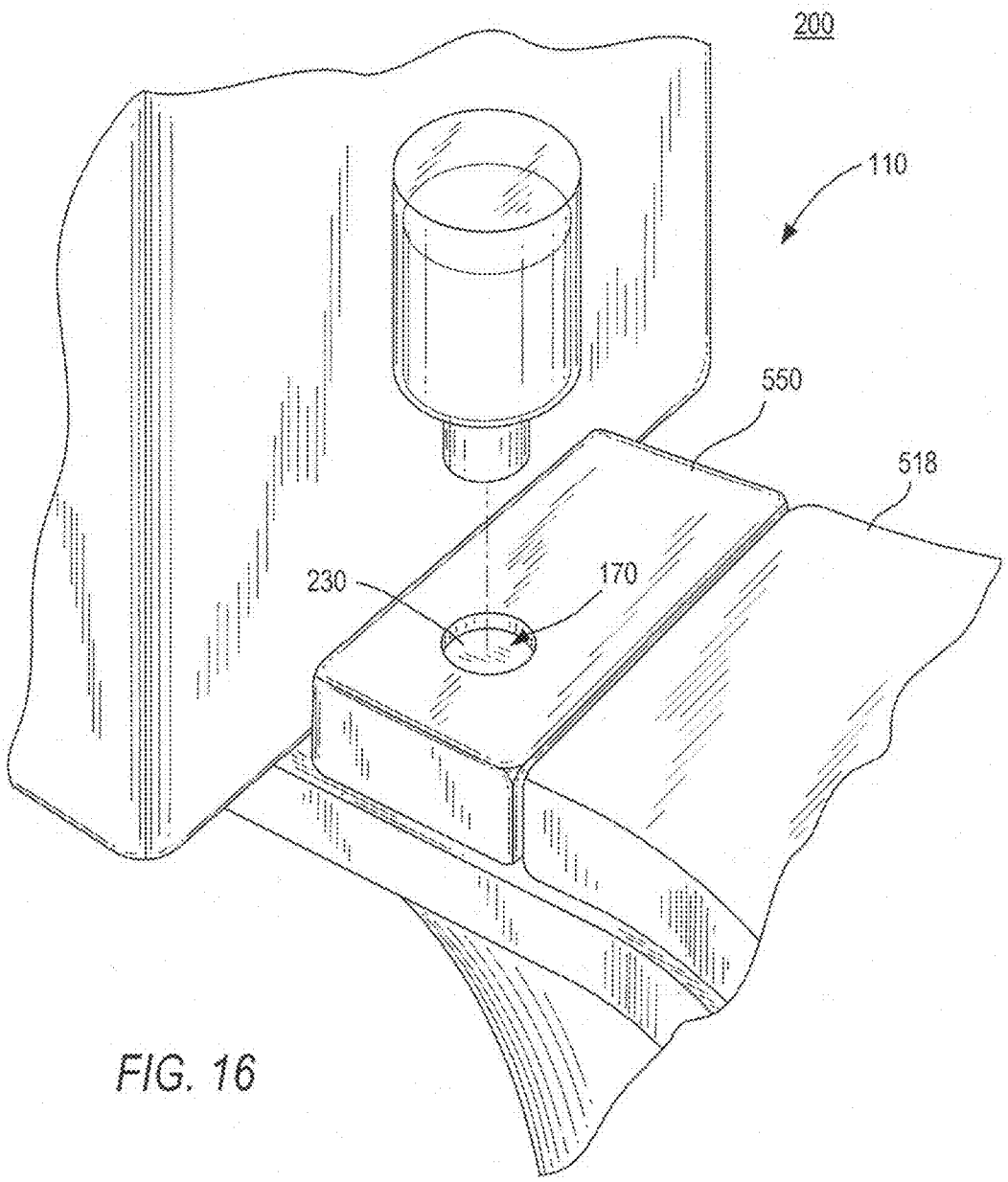
FIG. 16 shows a perspective view of another sanitaryware cleaning system, in accordance with various embodiments of the present invention.

FIG. 16 shows a perspective view of a sanitaryware cleaning system 200, in accordance with various embodiments of the present invention. Sanitaryware cleaning system 200 can include sanitary fixture 110, compartment enclosure 550, seat/cover 518, and reservoir 170. Enclosure 550 and seat/cover 518 may each be substantially similar to and, indeed, may be freely interchangeable with any of the enclosures and seat/cover combinations disclosed above with respect to FIGS. 11-15. The only difference between enclosure 550 and enclosure 150, 250, 350, and 450 disclosed above is that enclosure 550 houses reservoir 170 that receives and/or contains cleaning product 230 (e.g., from a bottle of liquid cleaning material as depicted in FIG. 16). In that respect, reservoir 170 may be likened to compartment 120 of FIGS. 1-15.

Compartment enclosure 550 can include an aperture in its top surface in fluid communication with reservoir 170 for receiving cleaning product 230. This aperture may be substantially similar to the apertures of enclosures 150, 250, 350, and 450, and may similarly be closed by a cap such as cap 152. Each of the embodiments disclosed below with respect to FIGS. 17-20 are similar in that they include a reservoir that may be filled with cleaning product 230 via the aperture in enclosure 550. These embodiments differ in the manner in which cleaning product 230 is released into waterway 140. However, each embodiment may be considered to include a normally-closed valve that opens when water is flowing through waterway 140 and closes once again when water ceases to flow.

FIG. 17 shows a cross-sectional view of compartment enclosure 550 housing reservoir 270, in accordance with various embodiments of the present invention. Cleaning product 230 may be introduced into reservoir 270 via the method described above. When water flows through waterway 140, arm 274 can be deflected from its neutral position, thereby opening valve 272 and permitting cleaning product to flow from reservoir 270 into waterway 114 and thereafter into bowl 116. Once water stops flowing through waterway 114, arm 274 returns to its neutral position, thereby closing valve 272.

FIG. 18 shows a cross-sectional view of compartment enclosure 550 housing reservoir 370, in accordance with various embodiments of the present invention. The embodiment depicted in FIG. 18 includes arm 374, which is operationally similar to arm 274 of FIG. 17. However, rather than manually opening a valve, arm 374 activates powered valve 372, which may be implemented, for example, as a battery-powered solenoid valve. FIG. 18 depicts powered valve 572 being powered by batteries 376; however, it should be understood that any suitable power source can be employed to power valve 372.

Figure 19:
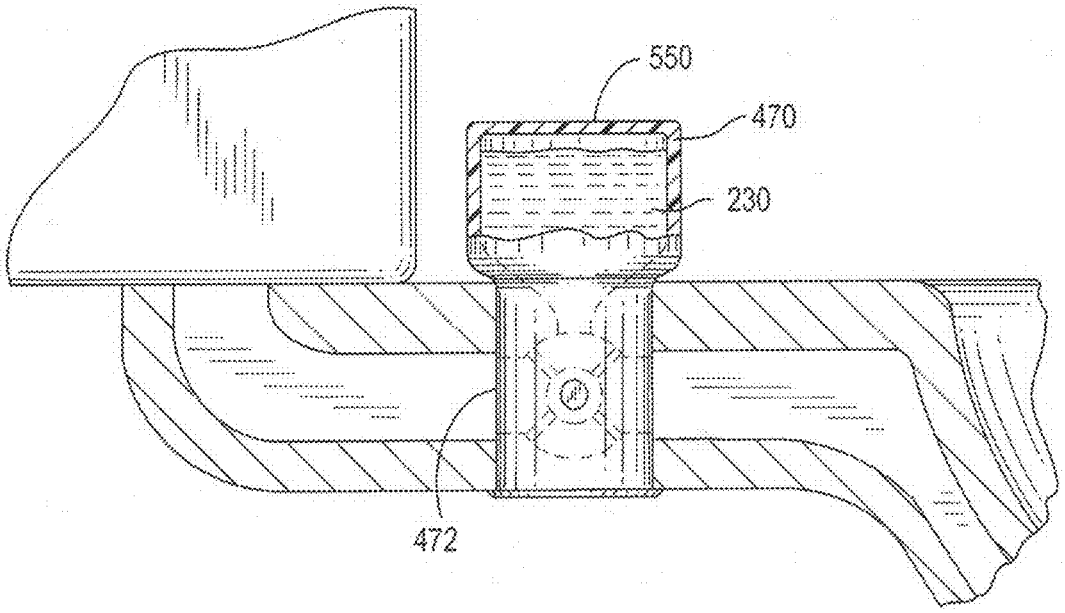
FIG. 19 shows a cross-sectional view of a compartment enclosure housing yet another reservoir, in accordance with various embodiments of the present invention.

FIG. 19 shows a cross-sectional view of enclosure 550 housing reservoir 470, in accordance with various embodiments of the present invention. Reservoir 470 may be in fluid communication with waterway 140 via compartment 472 that houses a pinwheel mechanism. The pinwheel mechanism may be configured to receive a measured amount of cleaning product 230 while in a rest position when water is not flowing in waterway 140. Once water begins to flow in waterway 140, the water can spin the pinwheel about a pivot point, thereby introducing the cleaning product into the water flowing toward bowl 116. The pinwheel can continue to spin, introducing more cleaning product 230 into the bowl until the flow of water through waterway 140 ceases.

Figure 20:
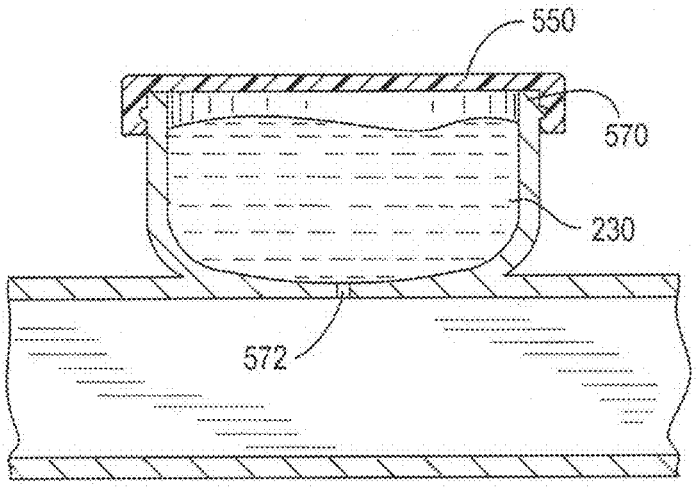
FIG. 20 shows a cross-sectional view of a compartment enclosure housing still another reservoir, in accordance with various embodiments of the present invention.

FIG. 20 shows a cross-sectional view of enclosure 550 housing reservoir 570, in accordance with various embodiments of the present invention. Reservoir 570 may be in fluid communication with waterway 114 via a capillary tube 572. When water begins to flow through waterway 140, the change in pressure can draw cleaning product 230 through capillary tube 572 and into the water flowing toward bowl 116. The amount of cleaning product 230 dispensed with each flush may be varied, for example, based on the diameter of capillary tube 572.

FIGS. 21A and 21B show perspective and cross-sectional views of a sanitaryware cleaning system 300, in accordance with various embodiments of the present invention. Sanitaryware cleaning system 300 can include sanitary fixture 110, seat/cover 618, and reservoir 670. Sanitaryware cleaning system 300 may be substantially similar to the embodiments disclosed above with respect to FIGS. 16-20 with the exception that the reservoir is located above the seat/cover rather than in a compartment enclosure. Indeed cleaning product 230 may be introduced into waterway 140 using any of the mechanisms depicted in FIGS. 17-20 adapted for the slightly altered flow path of cleaning product 230. As with compartment enclosure 550, cleaning product 230 may be introduced into an aperture formed in the top of seat/cover 618 that is in fluid communication with reservoir 670.

Figure 22:
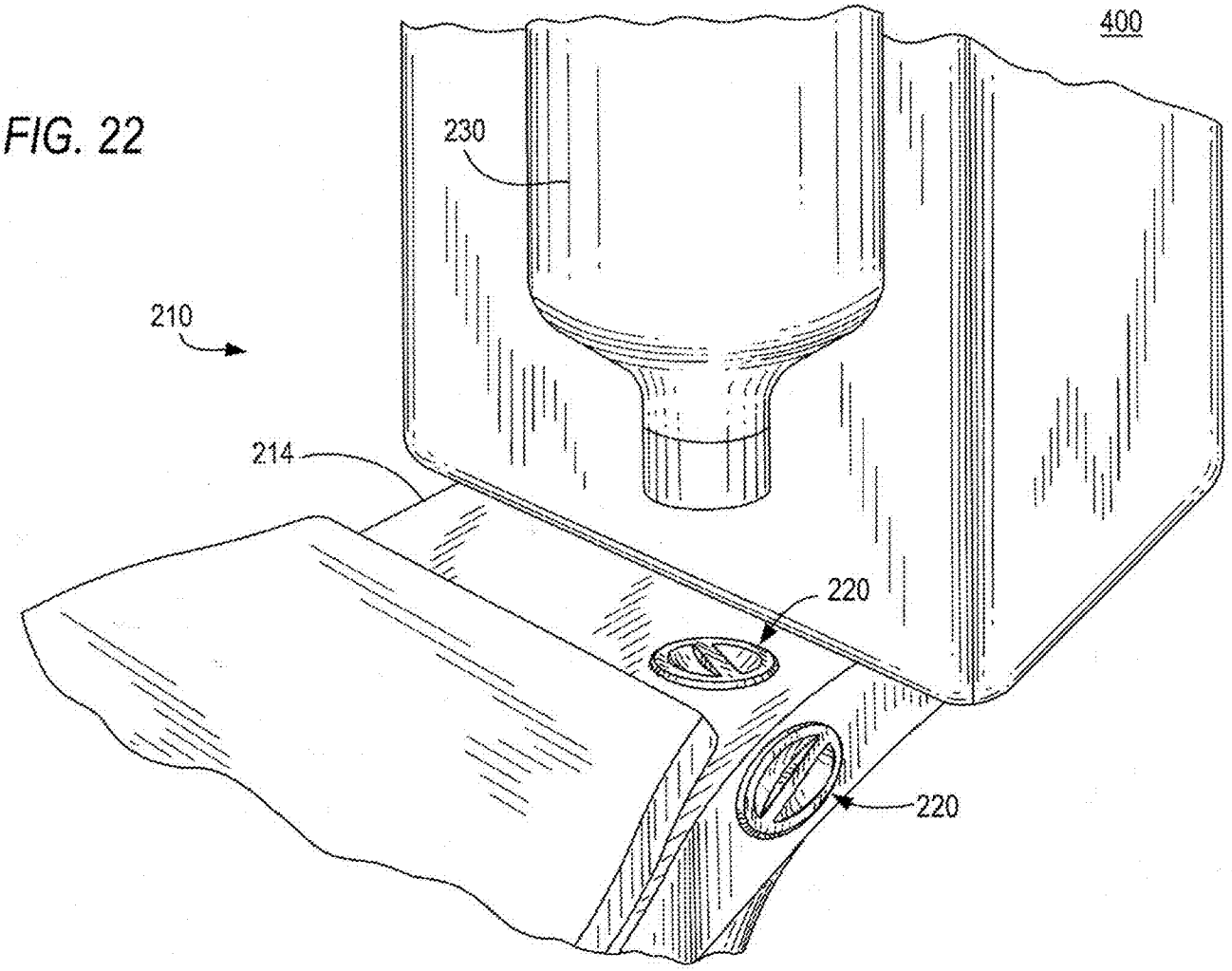
FIG. 22 shows a perspective view of another sanitaryware cleaning system, in accordance with various embodiments of the present invention.

FIG. 22 shows a perspective view of a sanitaryware cleaning system 400, in accordance with various embodiments of the present invention. Sanitaryware cleaning system 400 can include sanitary fixture 210, which may be substantially similar to sanitary fixture 110, with the exception that compartment 220 (akin to compartment 120 of FIG. 1) may be sized and shaped to receive a bottle of cleaning product 230. Thus, cleaning product may be received directly into a reservoir located under deck 214 of sanitary fixture 210. Once cleaning product 230 is introduced into the reservoir, it can be injected into waterway 140 using any of the mechanisms depicted in FIGS. 17-20 adapted for the slightly altered flow path of cleaning product 230. Sanitary fixture 210 may additionally or alternatively include a compartment formed in a side-facing surface of deck 214 in fluid communication with the reservoir.

Figure 23A:
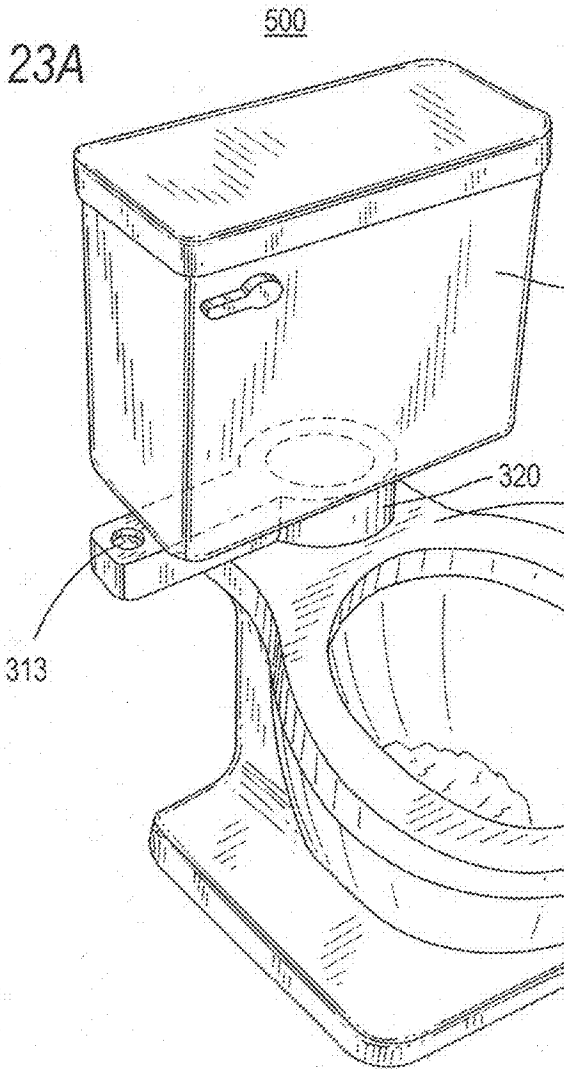
FIGS. 23A and 23B show perspective views of alternate embodiments of a sanitaryware cleaning system, in accordance with the present invention.
Figure 23B:
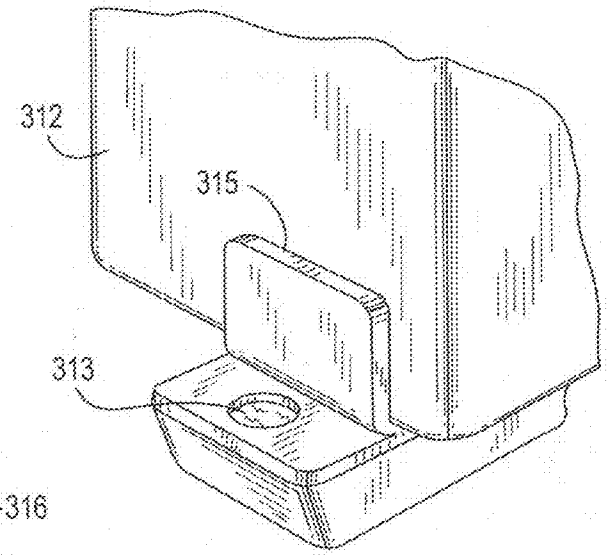

FIGS. 23A and 23B show perspective views of alternate embodiments of sanitaryware cleaning system 500. Sanitaryware cleaning system 500 can include sanitary fixture 310, which may be similar to sanitary fixture 210, with the exception that compartment 320 may be accessible from a fill port 313 located away from deck 314 and bowl 316. As depicted in FIG. 23A, for example, fill port 313 may be located under and extending away from tank 312. Cleaning product 230 may be introduced into the fill port, which may be in fluid communication with a reservoir that may be substantially similar to the reservoir of sanitary fixture 210. Once cleaning product 230 is introduced into the reservoir, it can be injected into waterway 140 using any of the mechanisms depicted in FIGS. 17-20 adapted for the slightly altered flow path of cleaning product 230. As illustrated in FIG. 23B, fill port 313 may be accessible via a flap 315 that closes fill port 313 when not in use.

Figure 24:
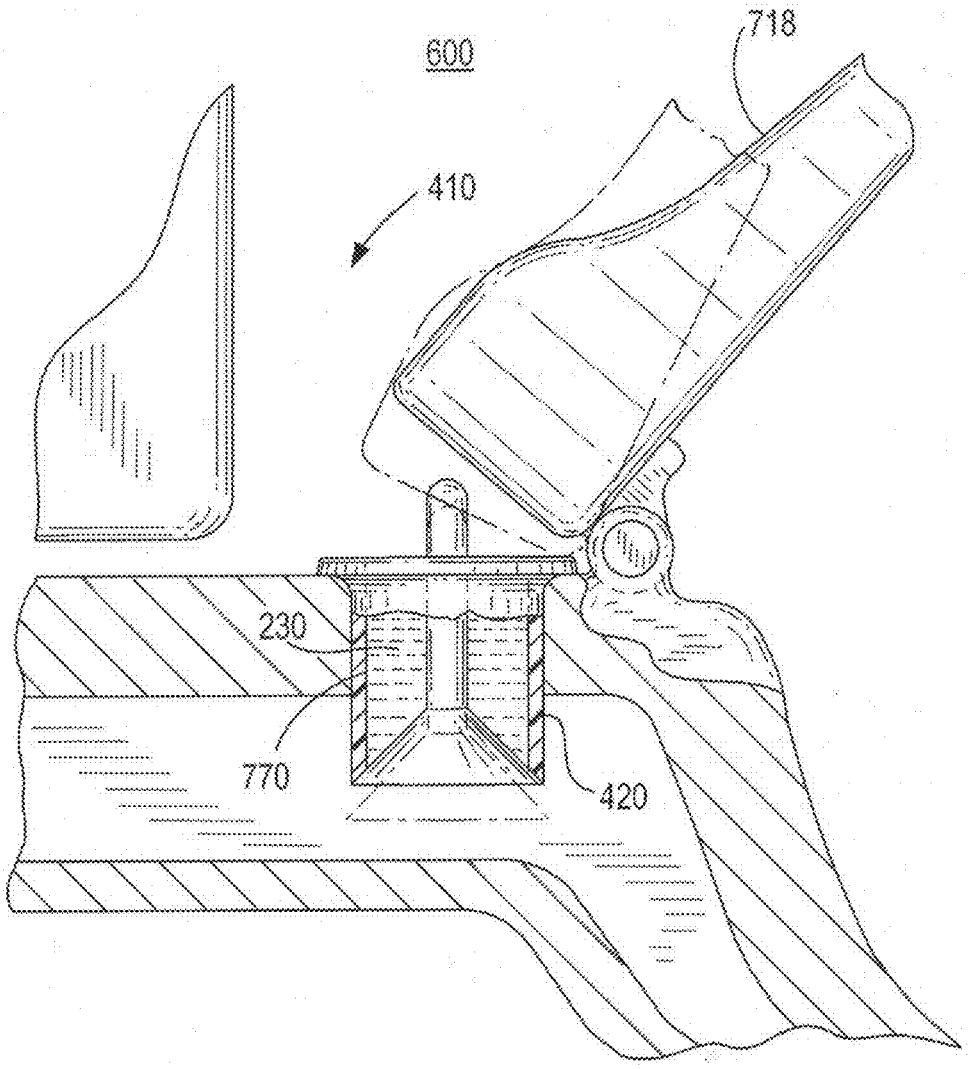
FIG. 24 shows a cross-sectional view of still another sanitaryware cleaning system, in accordance with various embodiments of the present invention.

FIG. 24 is a cutaway view of sanitaryware cleaning system 600, in accordance with various embodiments of the present invention. Sanitaryware cleaning system 600 can include sanitary fixture 410, which may be similar to sanitary fixture 210, with the exception that compartment 420 may be plunger activated by seat/cover 718. That is, cleaning product 230 may be introduced into reservoir 770, which may be substantially similar to the reservoirs of FIGS. 22, 23A, and 23B, and a measured amount of cleaning product 230 may be released into the waterway located below reservoir 770 when the plunger is contacted by seat/cover 718.

FIGS. 25A-42 are various views of alternate exemplary sanitaryware cleaning systems and their associated components.

Figure 25A:
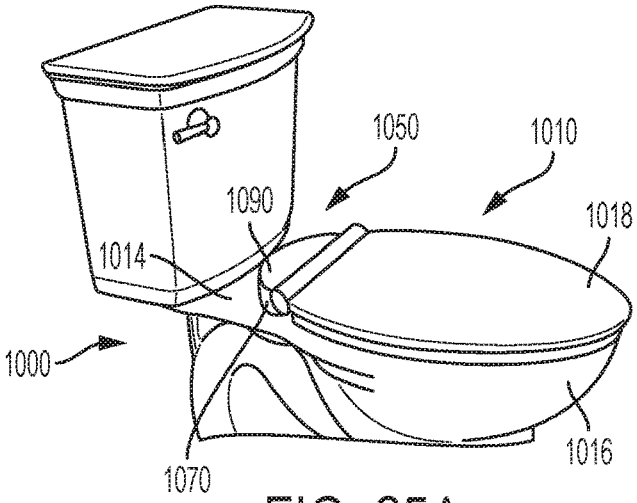
FIGS. 25A-25C are various views of an exemplary sanitaryware cleaning system, in accordance with another embodiment of the present invention.
Figure 25B:
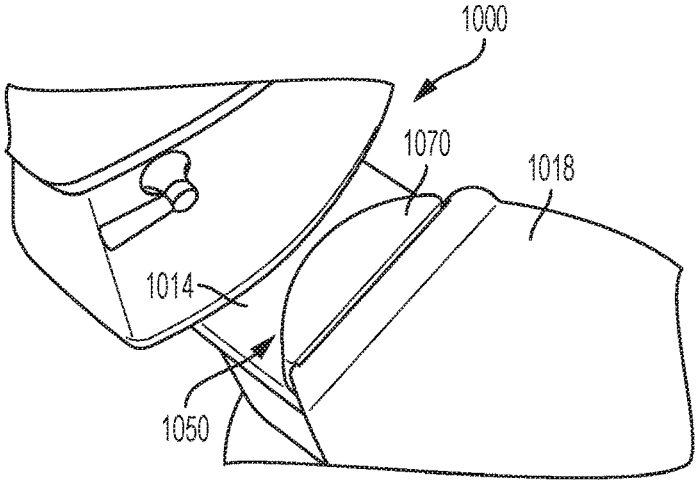
Figure 25C:
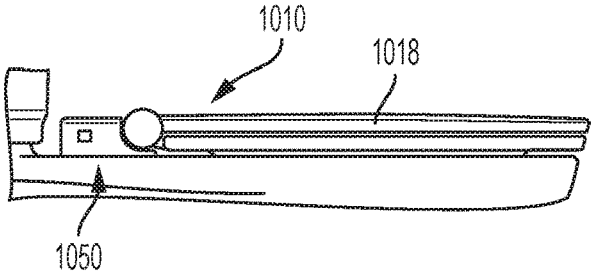
Figure 26A:
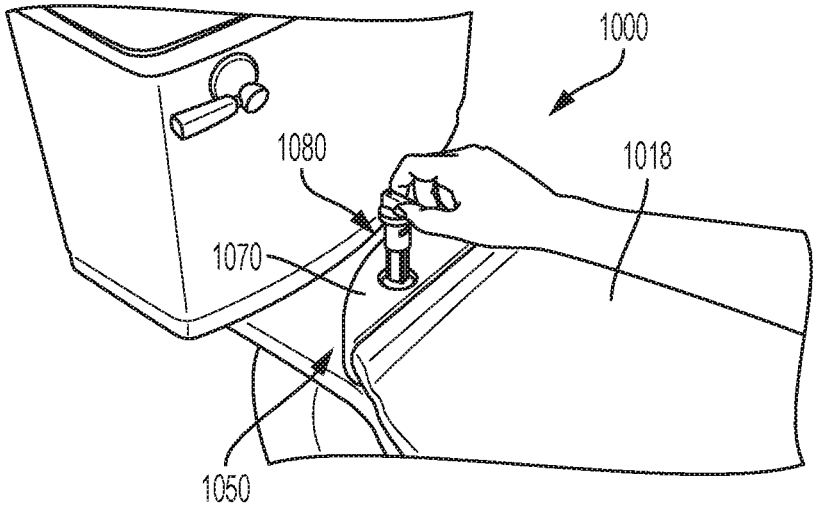
FIGS. 26A and 26B are perspective views of the sanitaryware cleaning system of FIGS. 25A-25C, illustrating different operational states.
Figure 26B:
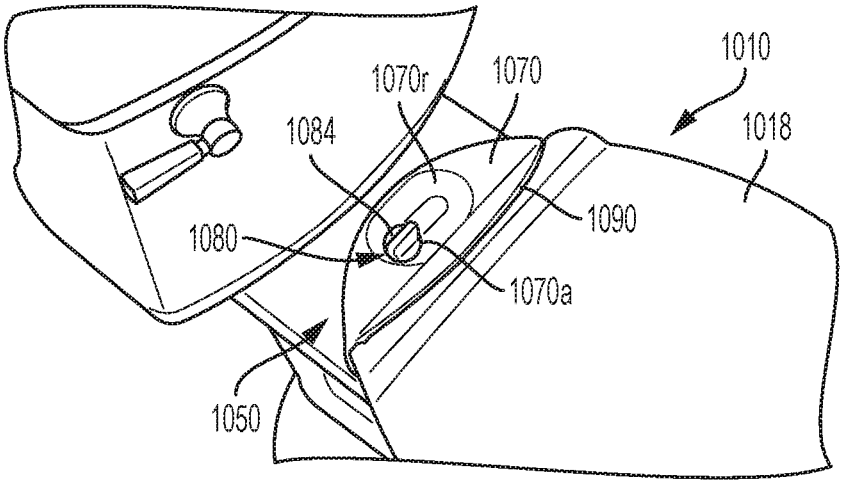

As shown in FIGS. 25A-25C, 26A, 26B, 27A, and 27B, system 1000 can include a sanitary fixture 1010, and a cleanser assembly having a cartridge housing 1050 and a cleaning product cartridge 1080. A compartment/reservoir can be defined in deck 1014. Cartridge housing 1050 can be mountable onto deck 1014 over the compartment and adjacent to seat/cover 1018 (e.g., adjacent to a rear hinged portion of seat/cover 1018), and can be configured to receive cartridge 1080 and introduce the cartridge at least partially into the compartment (FIG. 26A). In certain embodiments, cartridge housing 1050 can be disposed on the deck at a suitable distance from the tank (if any), so as to allow easy user access to the housing during servicing at the housing or cleaning of fixture 1010.

Embodiments of the cartridge housing and cartridge can be employed in any toilet that includes one or more water flow paths leading into the bowl. In toilets that utilize separate flow paths for rim and jet flows, such as those that employ VorMax™ toilet flush technology, the cartridge housing can be installed over the compartment in the rim flow path, allowing the cleaning product to only contact water in that path. The VorMax™ flush technology is discussed in detail in U.S. Patent Application Publication Nos. 2015/0197928 and 2016/0002903, both of which are herein incorporated by reference in their entireties.

Referring to FIGS. 27A, 27B, 28A, and 28B, housing 1050 can include a base portion 1060 having one or more openings 1062 configured to couple to seat posts 1065. Base portion 1060 with seat posts 1065 can support a rear portion of seat/cover 1018 when the seat/cover is installed. In some embodiments, seat posts 1065 can also couple to complementary features (e.g., openings, via threaded coupling, press-fitting, or the like) in deck 1014. Housing 1050 can also include a platform 1070 disposed on base 1060. A receptacle or aperture 1070*a* can be defined in platform 1070 to receive cartridge 1080. When cartridge housing 1050 is properly installed to fixture 1010, aperture 1070*a* aligns with the compartment in the deck and introduces cartridge 1080/cleaning product 1030 therein. In certain embodiments, aperture 1070*a* can be defined within a recess 1070*r* defined proximate the center on the upper surface of platform 1070 (see, e.g., FIG. 27B).

Figure 29:
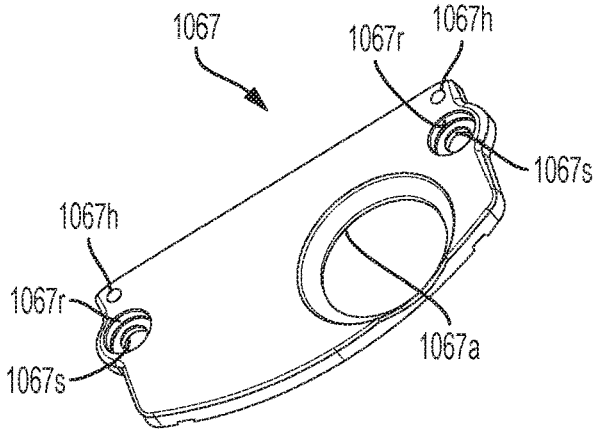
Figure 30:
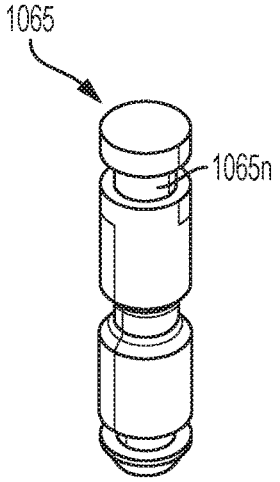

Referring to FIG. 29, housing 1050 can include a seat plate 1067 disposable adjacent to an underside of base 1060. Seat plate 1067 can be defined with holes 1067*h* configured to align with corresponding holes on deck 1014, and through which one or more fasteners can be disposed to secure the seat plate onto the deck. Seat plate 1067 can also include openings 1067*s* configured to receive, or otherwise, retain seat posts 1065. In certain embodiments, each opening 1067*s* can be defined in a recess 1067*r* configured to accommodate neck portion 1065*n* (FIG. 30) of a corresponding seat post 1065 when the seat post is coupled to the opening.

As shown in FIG. 29, seat plate 1067 can also be defined with an aperture 1067*a* configured to align with aperture 1070*a* of platform 1070 as well as the compartment in deck 1014. This can allow cartridge 1080 to pass therethrough (e.g., through apertures 1070*a* and 1067*a*) and at least partially into the compartment. In some embodiments, aperture 1067*a* can have a circumference that is larger than that of aperture 1070*a*.

Referring to FIGS. 31A-31E, cartridge 1080 can include a body 1082, a cap 1084, and cleaning product 1030.

Body 1082 can include a main section 1082*m*, and a plurality of legs 1082*g* that merge to form a lower portion of the body. This construction can provide a basket-like structure having slots 1082*s* that allow cleaning product 1030 to contact and dissolve into water flowing toward the bowl.

Cartridge 1080 can have a length sufficient to allow cleaning product 1030 to not only pass through aperture 1070*a*, but also at least partially enter into the compartment. According to a preferred embodiment, the compartment is a pathway that allows water to pass therethrough during a flush and contact cleaning product 1030 prior to entering the bowl.

The length of cartridge 1080 and/or the extent to which the cartridge can enter into the compartment can preferably be defined such that a gap exists between the lower portion of body 1082 and the compartment surface (e.g., bottom surface of the rim flow path) when the cartridge is installed. The size of the gap should be sufficient to allow a suitable amount of cleaning product to be disposed in cartridge 1080 without the cartridge actually contacting the compartment surface (e.g., about 3 millimeters). Such a gap can minimize any turbulence that the cartridge may cause to the water flow.

The size and shape of body 1082 and/or the thickness and arrangement of legs 1082*g* are preferably defined so as to minimize drag force on and/or turbulence in the water flowing (e.g., in the rim flow path) toward the bowl. For example, body 1082 and legs 1082*g* can have a tapered profile, reducing the cartridge surface area exposed to the water flow. In certain embodiments, the spacing between legs 1082*g* can also be defined to allow cleaning product 1030 to exit cartridge 1080 and flow with the water (e.g., in the rim flow path) when the cleaning product has diminished to an insignificant size—e.g., a size in which the remaining product will easily, fully dissolve in the water and not clog the flow path. The construction of cartridge 1080 can thus be optimized to allow prolonged use of cleaning product 1030 and thus extended times between replacements of the cartridge and/or cleaning product (e.g., to 30 days or more).

Body 1082 can include one or more alignment protrusions 1082*p* (see, e.g., FIGS. 31A-31C) configured to align with complementary features in or proximate aperture 1070*a* of platform 1070. When the cartridge is inserted into aperture 1070*a* and rotated in an appropriate direction, protrusions 1082*p* can, for example, align and/or releasably couple to such complementary features to secure or lock cartridge 1080 to cartridge housing 1050. Main section 1082*m* is preferably solid throughout its surface, which can provide added protection from leaks in or through cartridge 1080 (e.g., should any O-ring(s) used to seal cartridge 1080 in aperture 1070*a* become compromised).

Cartridge 1080 can be a reusable unit that receives a new cleaning product 1030 when a prior one is depleted. For example, cleaning product 1030 can be inserted/re-inserted into body 1082 by removing cap 1084 from the body. Alternatively, cartridge 1080 can be a disposable unit that is replaced when cleaning product 1030 is depleted. In either case, cartridge 1080 can be composed of any suitable material, such as, e.g., polypropylene, biodegradable material [e.g., polylactic acid, polyvinyl chloride (PVC), polycaprolactone, polyesters, aromatic-aliphatic esters, etc.], or the like.

Figure 31A:
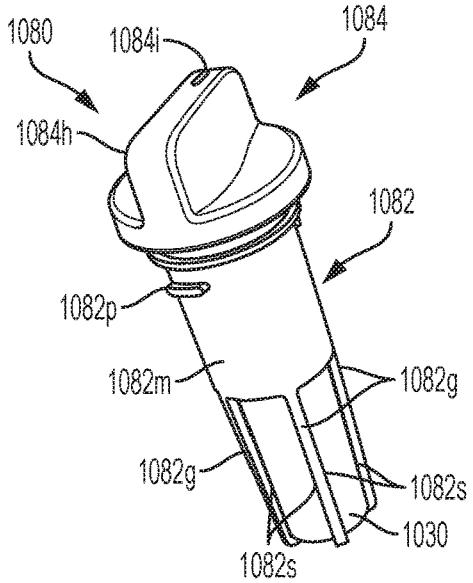
FIGS. 31A and 31B are perspective and side elevational views of an exemplary cartridge, in accordance with an embodiment of the present invention.
Figure 31B:
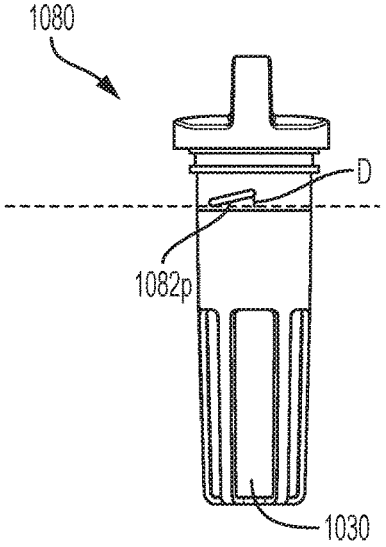
Figure 31C:
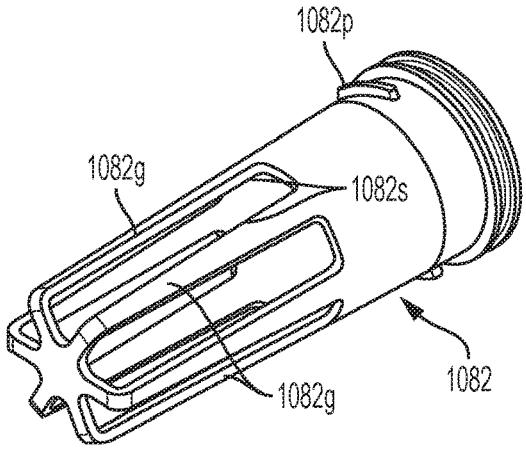
FIG. 31C is a perspective view of an exemplary body of the cartridge shown in FIGS. 31A and 31B.
Figure 31D:
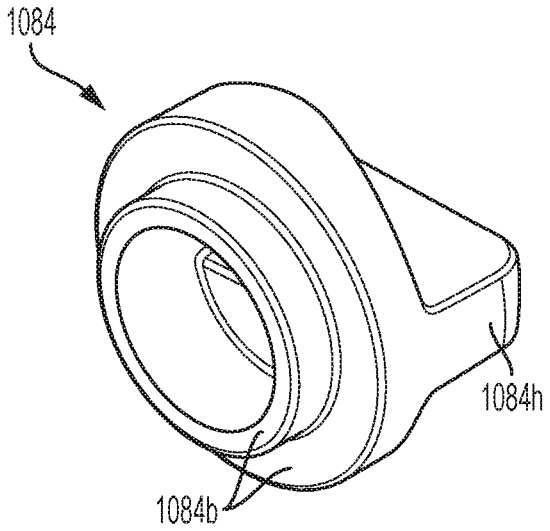
FIGS. 31D and 31E are various views of an exemplary cap of the cartridge shown in FIGS. 31A and 31B.
Figure 31E:
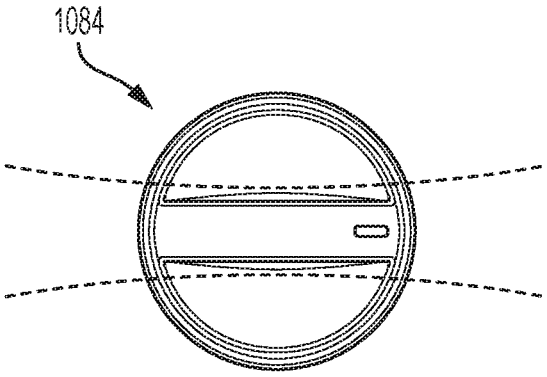
Figure 32A:
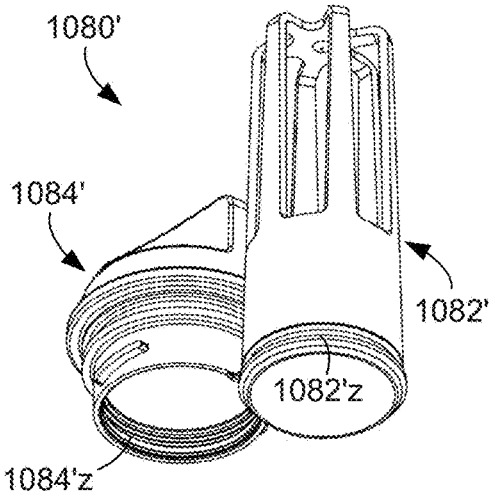
FIG. 32A is a perspective view of a body and a cap of another exemplary cartridge in accordance with an embodiment of the present invention.
Figure 32B:
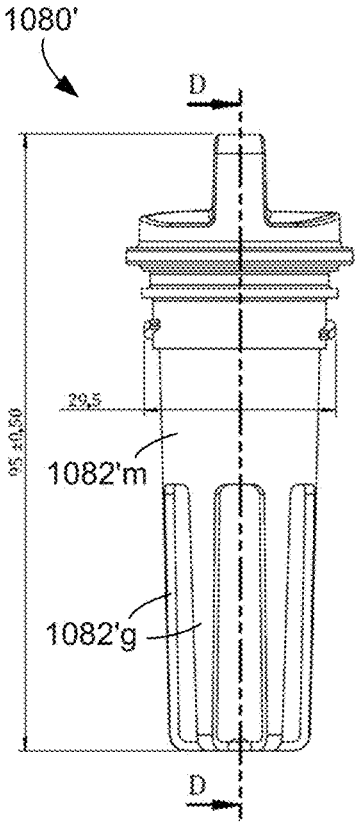
FIGS. 32B-32F are various views of the cartridge shown in FIG. 32A, illustrating exemplary dimensions thereof.
Figure 32C:
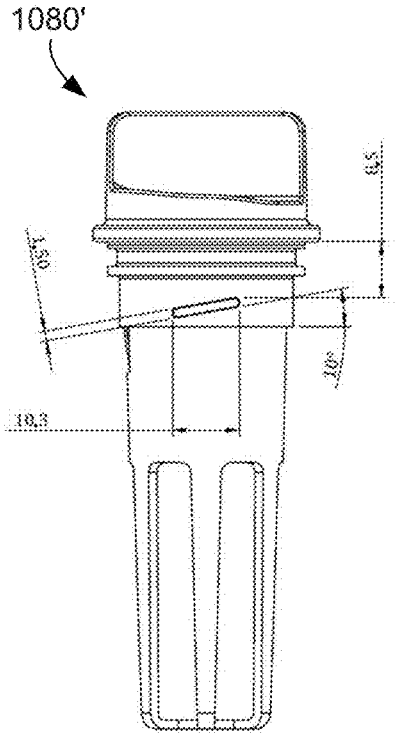
Figure 32D:
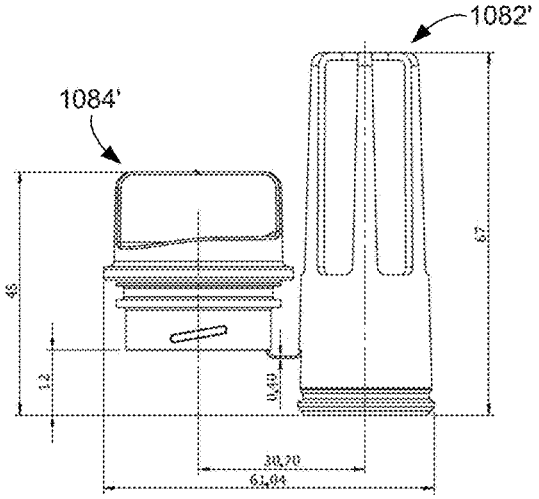
Figure 32F:
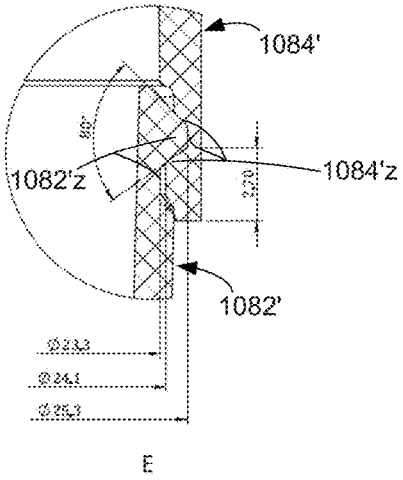
Figure 32E:
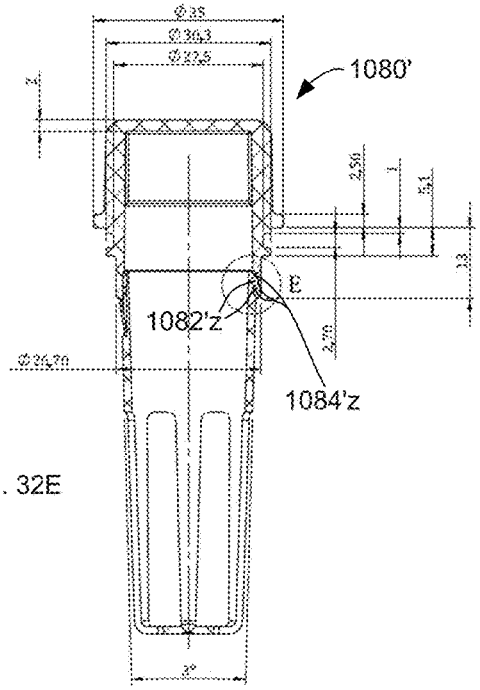

As shown in FIGS. 31D and 31E, for example, cap 1084 can include a base 1084*b* configured to couple to body 1082, and a grip handle 1084*h*. Cap 1084 can be secured to body 1082 in any suitable manner, such as, e.g., via a press-fit coupling, a snap and lock coupling, or a squeeze-and-turn, push-down-and-turn, or push-tab-and-turn threaded coupling. Securing the cap can limit access to the cleaning product when disposed in the cartridge, and protect children and/or pets from hazardous chemicals that may be present therein. For example, in a preferred embodiment, once the cleaning product is inserted into the cartridge, the cap can be snapped into the body and locked such that a user would not be able to open it to access or remove the product.

Referring to FIGS. 32A-32F, which show a preferred cartridge embodiment that includes a body 1082' and a cap 1084' (along with exemplary dimensions thereof in millimeters/degrees), the cap can be coupled to body 1082' and locked thereto via complementary coupling members 1082'*z* and 1084'*z* on the body and the cap. Coupling members 1082'*z* and 1084'*z* can include one or more flanges, threads, or the like that interconnect with one another when cap 1084' is positioned on body 1082' and joined thereto.

It should be appreciated that the dimensions of the body and cap of the cartridge shown in FIGS. 32A-32F are merely exemplary, and that the various components of either cartridge 1080 or 1080' can have any suitable dimensions. For example, the distance between each leg 1082'*g* (or leg 1082*g*) can range from 5 mm to 9 mm [e.g., preferably about 7 mm at the leg ends proximate main section 1082'*m* (or main section 1082*m*) to about 8 mm at the ends proximate the bottom portion of the cartridge] so as to allow cleaning product 1030 to exit the cartridge and flow with the water when the cleaning product has diminished to an insignificant size, as described above. It is understood that the present disclosure envisions ranges between any two recited endpoints.

The handle of the cap can also have any suitable height. As shown in FIG. 31E, for example, handle 1084*h* can be defined with a slight curvature such that the thickness proximate the center of the handle is less than that at the ends of the handle. The dimensions and placement of handle

1084*h* can facilitate access to cartridge 1080 during installation and/or replacement, even for users with large hands or fingers.

Figure 33:
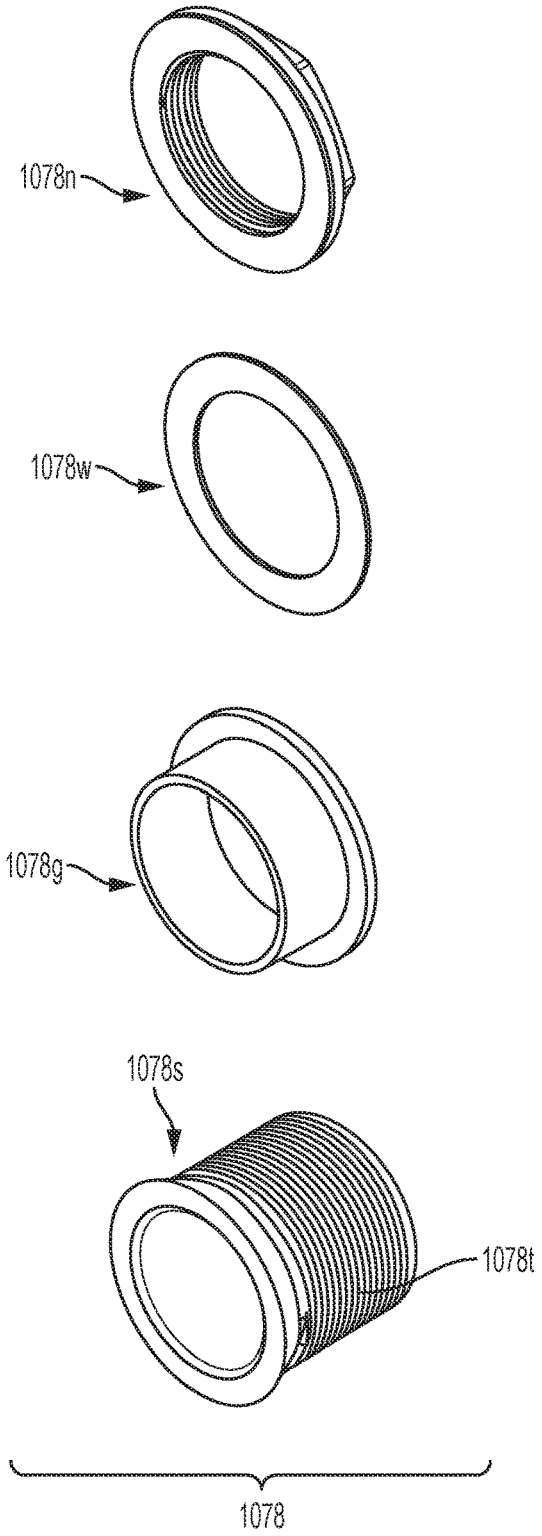
FIG. 33 are magnified views of various components of a spud assembly, in accordance with an embodiment of the present invention.
Figure 34:
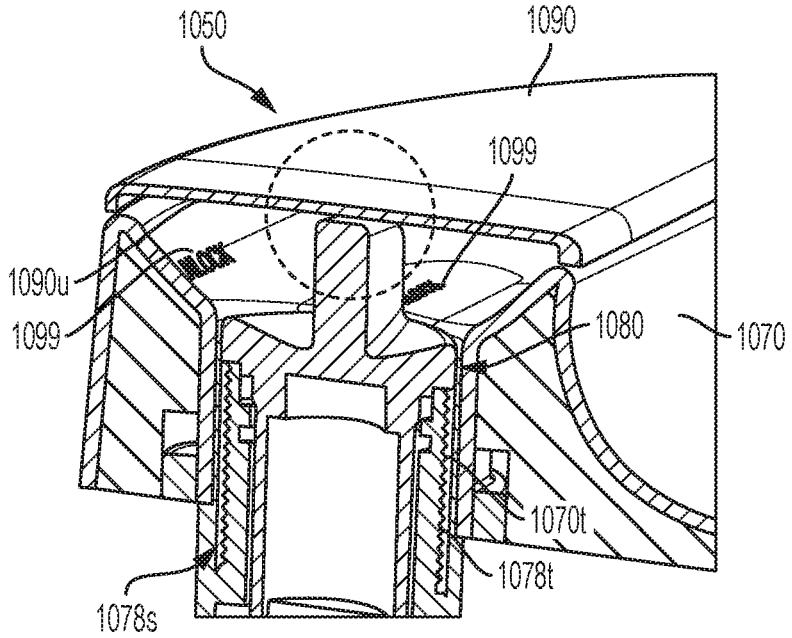
FIG. 34 is a cross-sectional view of an exemplary cartridge housing with the spud assembly shown in FIG. 33, in accordance with an embodiment of the present invention.
Figure 35:
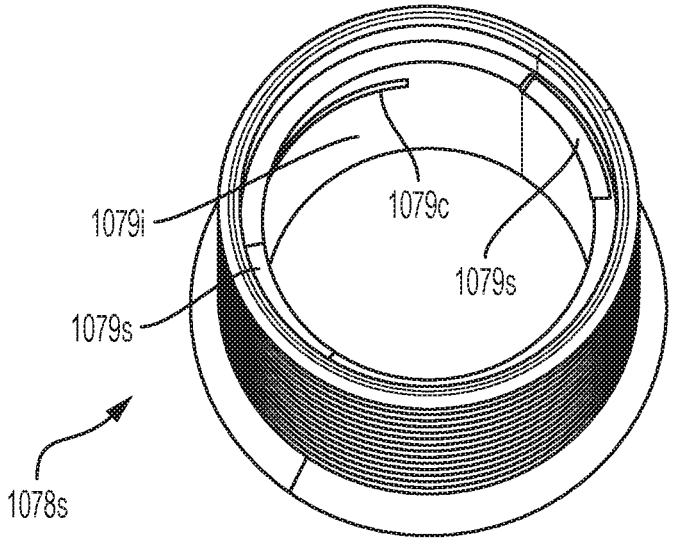
FIG. 35 is a top perspective view of a spud of the spud assembly shown in FIG. 33.

Referring to FIGS. 33 and 34, the cartridge (e.g., such as cartridge 1080 or 1080') can be coupled to aperture 1070*a* via a spud assembly 1078. Spud assembly 1078 can include spud 1078*s*, gasket 1078*g*, O-ring washer 1078*w*, and nut 1078*n*. These components can be appropriately oriented and coupled to spud 1078*s* to further secure the spud and/or provide a water-tight seal.

As shown in FIG. 33, spud 1078*s* can include threaded portions 1078*t* about its exterior surface configured to couple to complementary threads 1070*t* in aperture 1070*a*. Spud 1078*s* can also include one or more slots 1079*s* and channels 1079*c* (FIG. 35) configured to interoperate with complementary protrusions of the cartridge body (e.g., protrusions 1082*p*). Slots 1079*s* and channels 1079*c* can be defined in an interior surface 1079*i* of spud 1078*s*, and can each run along the interior surface in a downward, spiral-like manner. This configuration of slots and channels can, for example, accommodate the slanted protrusions 1082*p* on body 1082 (angle D in FIG. 31B).

Figure 36A:
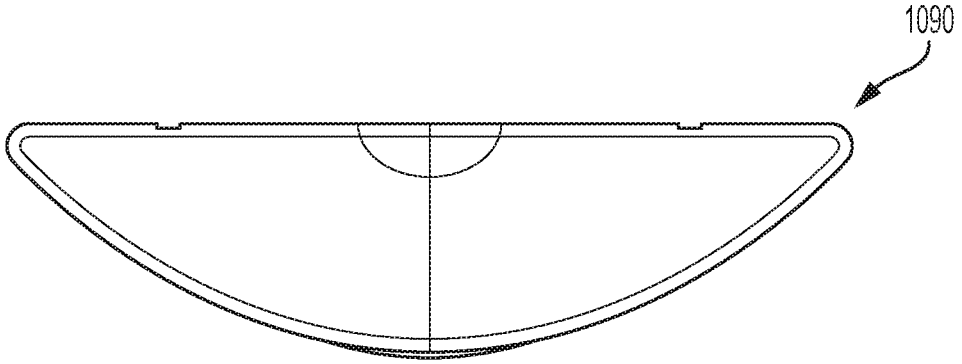
FIGS. 36A and 36B are top and bottom views of an exemplary cartridge housing lid, in accordance with an embodiment of the present invention.
Figure 36B:
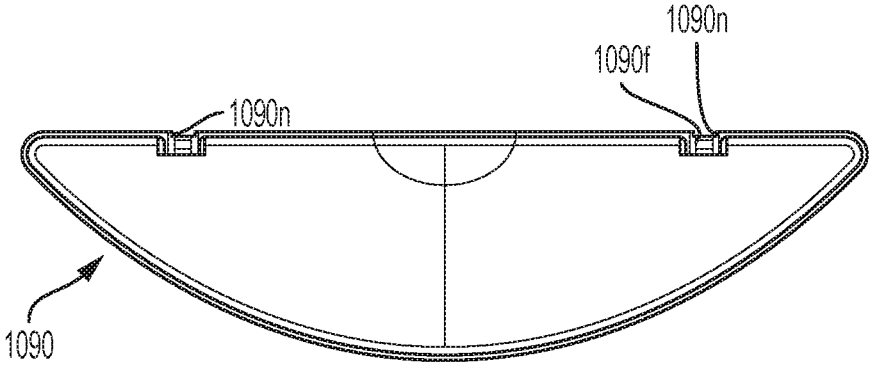

Referring to FIGS. 36A and 36B, a lid 1090 can cover the upper surface of housing 1050, particularly recess 1070*r* and aperture 1070*a* of platform 1070. In various embodiments, lid 1090 can include one or more notches 1090*n* having pins or flanges 1090*f* configured to couple to corresponding arms that interface with platform 1070.

Figures 37A, 37B, 37C:
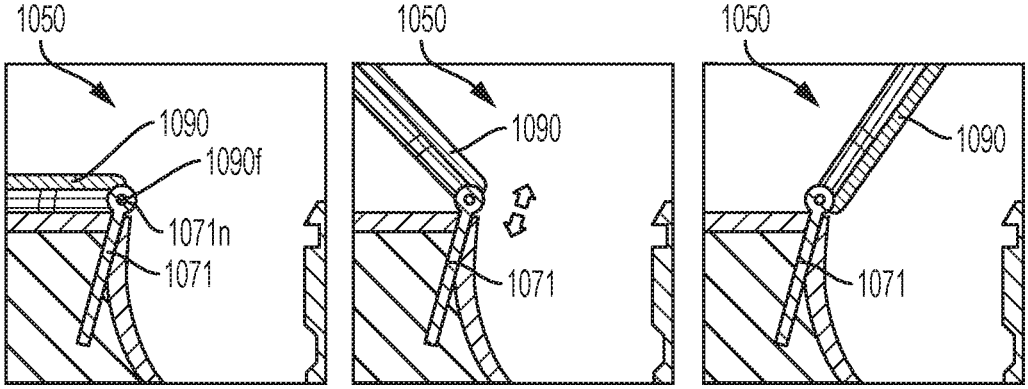
FIGS. 37A-37C are partial side cross-sectional views illustrating the lid shown in FIGS. 36A and 36B in closed, partially open, and fully open positions.

In an exemplary embodiment shown in FIGS. 37A-37C, flanges 1090*f* of lid 1090 can be coupled to arms 1071 via openings 1071*n*. Arms 1071, which can be disposed in platform 1070, can be biased by one or more springs, or other elastic elements to keep lid 1090 open. Arms 1071 can be displaceable (e.g., through corresponding openings in platform 1070), allowing the connection or hinge points (e.g., between arms 1071 and pins/flanges 1090*f*) to shift in generally upward and downward directions during opening and closing of lid 1090, as shown in FIGS. 37A-37C. This can provide added leak protection for housing 1050, by defining a minimum gap requirement between a top surface of grip handle 1084*h* and undersurface 1090*u* of lid 1090. Particularly, the configuration of protrusions 1082*p*, slots 1079*s*, and channels 1079*c* can keep cartridge 1080 from fully entering aperture 1070*a* when inserted, unless the protrusions, slots, and channels are properly aligned and engaged. In an unsecured cartridge position, grip handle 1084*h* may be raised just enough that it contacts undersurface 1090*u* of lid 1090 when a user attempts to close the lid (see, e.g., FIG. 34). This, in turn, pulls arms 1071 upward from platform 1070, as shown in FIGS. 37A-37C, resulting in an improperly shut lid. Cartridge 1080 must then be securely locked in aperture 1070*a* in order for lid 1090 to fully and properly close. The ability of the arm 1071 hinge points to rise, taken in conjunction with the configuration of protrusions 1082*p*, slots 1079*s*, and channels 1079*c*, can thus alert a user to an improperly installed cartridge.

Figure 38:
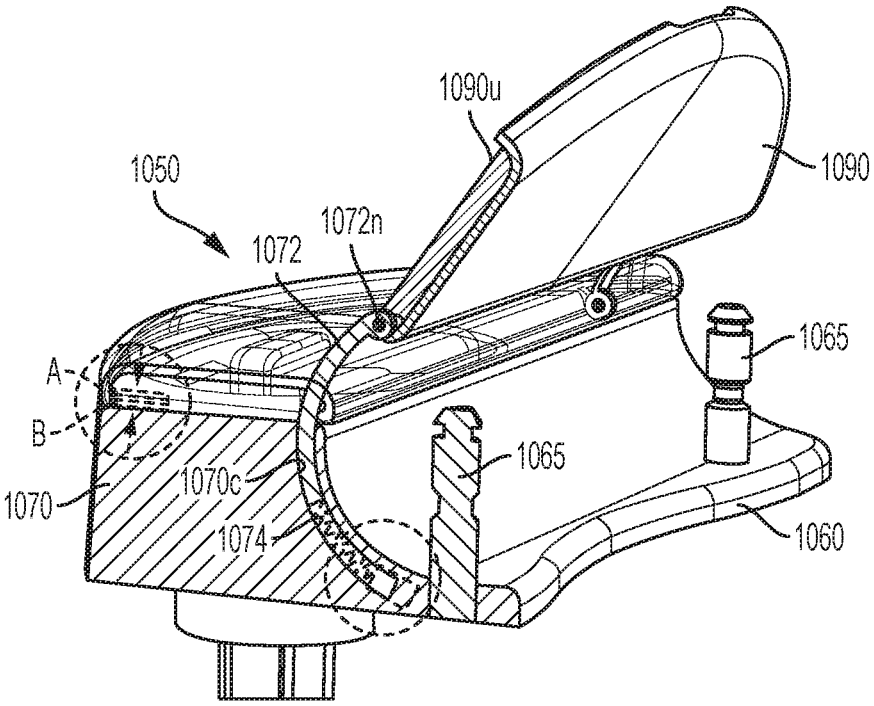
FIG. 38 is a perspective, partially transparent, cross-sectional view of an exemplary spring-loaded cartridge housing, in accordance with an embodiment of the present invention.

In another exemplary embodiment shown in FIG. 38, the lid can be coupled to the enclosure via a spring-loaded, curved hinge mechanism. For example, platform 1070 can be defined with one or more channels 1070*c* configured to slidably receive corresponding arms 1072 that interface with lid 1090. Arms 1072 can be slidably inserted into respective channels 1070*c*, and can include openings 1072*n* configured to couple, for example, to pins/flanges 1090*f* of lid 1090. A spring 1074, or other similar elastic member, can be disposed within each channel 1070*c* to bias a corresponding arm 1072 so as to open lid 1090. In its open position, lid 1090 can thus remain open to allow for uninterrupted user access to cartridge 1080 during installation and/or replacement thereof.

In various embodiments, channels 1070*c* and arms 1072 can have similar curvatures. The curvatures can be defined to correspond to the curvature of platform 1070 proximate a hinge structure for seat/cover 1018 (see, e.g., FIG. 25C), which can facilitate rotational movement of lid 1090, during opening and closing thereof, at least partially about the seat/cover's hinge structure.

It should be appreciated that the cartridge housing embodiments described above can provide an overall cleaner look, since they lack parting lines that may otherwise be associated with conventional hinges.

Additionally, employing dual-arm hinge constructions, such as those described above, can be preferable over those with single, centralized hinge mechanisms, since distorted movement of the lid can be avoided even when the lid is lifted from its side. In certain embodiments, housing 1050 and/or lid 1090 can include with one or more of notches, angled or curved side profiles, or the like, that further facilitate user access to and lifting of the lid.

Furthermore, in some or all of the cartridge housing embodiments that employ arms 1071 or arms 1702, lid 1090 can open, e.g., toward seat/cover 1018 or a tank (if any), by a predefined amount so as to provide sufficient room for user access to cartridge 1080 during cartridge installation/replacement. Embodiments that have the lid open toward seat/cover 1018 (rather than toward the fixture's tank, if any), in particular, can be more aesthetically pleasing, and can avoid the lid interfering with a user's hands during installation/replacement.

In some embodiments, lid 1090 can also have round edges, rather than sharp ones, to facilitate cleaning of housing 1050 and avoid collection of dirt or dust. Likewise, housing 1050 can also include only rounded exterior edges.

Figure 39:
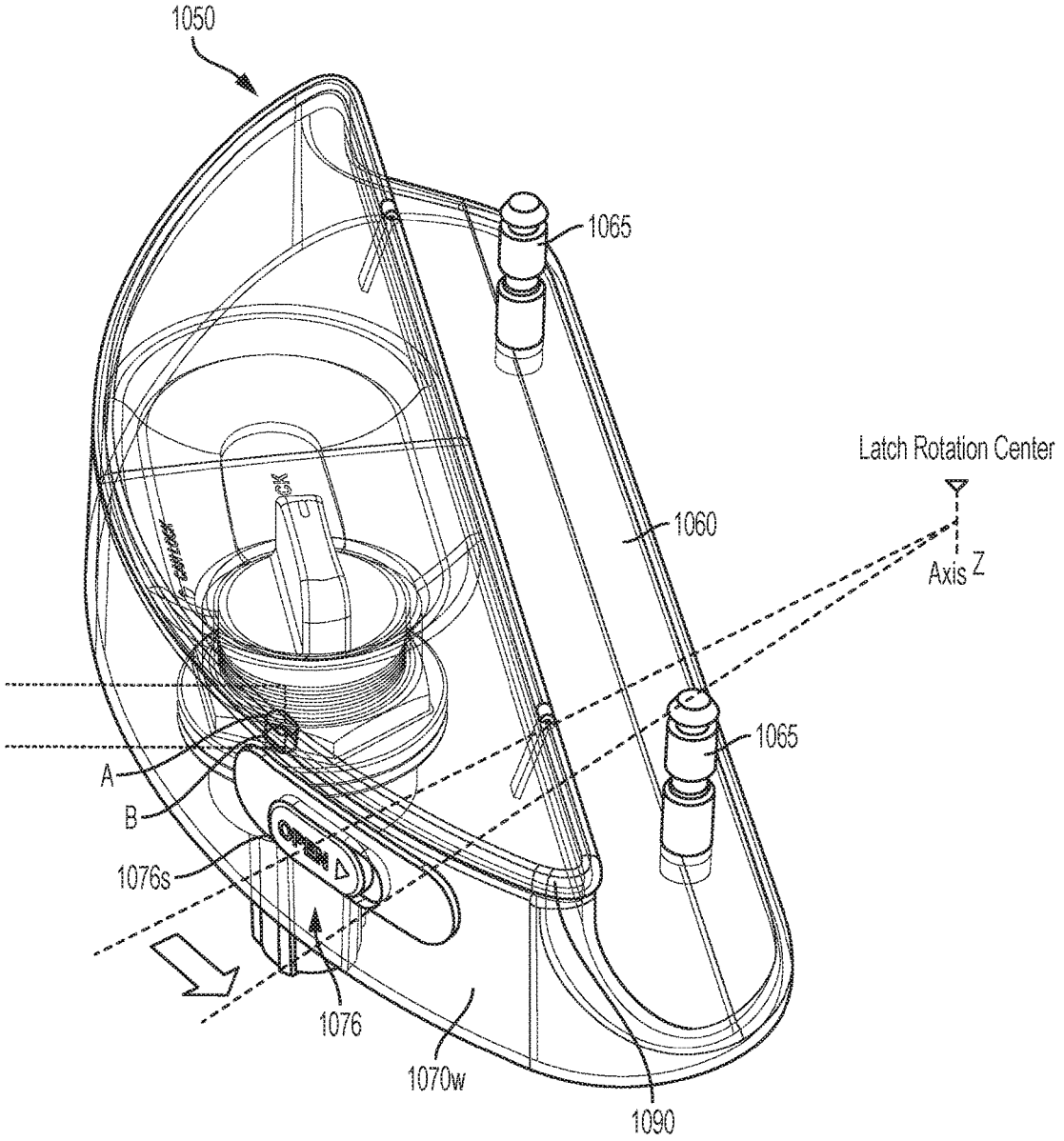
FIG. 39 is a perspective, transparent view of an exemplary cartridge housing having a latch assembly, in accordance with an embodiment of the present invention.
Figure 40A:
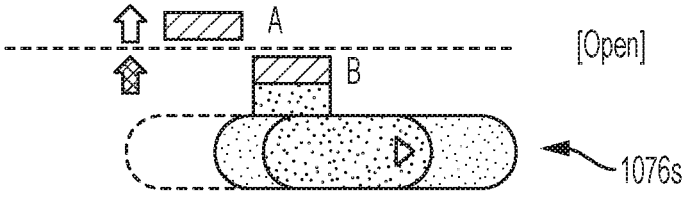
FIGS. 40A and 40B are schematic views of the latch assembly shown in FIG. 39, illustrating the latch assembly in open and closed states.
Figure 40B:
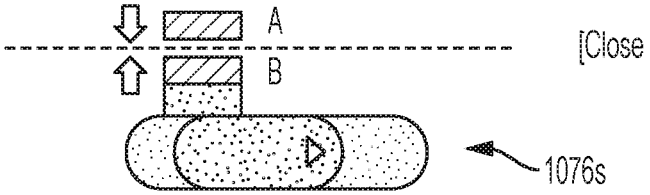

Referring to FIGS. 39, 40A, and 40B, embodiments of the cartridge housing can include a latch assembly configured to releasably secure the lid to the platform. The latch assembly can be employed with any of the varying hinge mechanism embodiments described above. Latch assembly 1076 can be a magnetic mechanism, and can include a slidable latch 1076*s* disposed in a wall 1070*w* of platform 1070, and corresponding elements A and B having complementary magnetic polarities. Magnetic element A can be affixed to undersurface 1090*u* of lid 1090 (e.g., via an adhesive or the like), and magnetic element B can likewise be affixed to a portion of latch 1076*s*. In closed position, latch 1076*s* is disposed such that magnetic element B at least partially aligns and attracts magnetic element A. In open position, latch 1076*s* is disposed such that magnetic element B is shifted from magnetic element A.

In certain embodiments, latch assembly 1076 can include a spring element to bias the latch to its closed position. When a sufficient force is applied to latch 1076*s*, the bias of the spring can be overcome, allowing the latch to open. In various embodiments, latch 1076*s* can also be configured to slide in wall 1070*w* in accordance with the curvature of the wall. As shown in FIG. 39, for example, latch 1076*s* can slide in wall 1070*w* about a latch rotation axis Z.

Alternate embodiments of the cartridge housing can employ a simpler magnetic latch assembly that includes only magnetic elements, without a separate latch (see, e.g., FIG. 38). This requires fewer or no holes on housing 1050 and/or lid 1090. In these embodiments, lid 1090 can remain closed when magnetic elements A and B are in close proximity to one another, and can open when sufficient force is applied to counteract the magnetic force. It should be appreciated that this simpler magnetic latch assembly can be employed in any of the hinge mechanism embodiments described above.

Figure 27A:
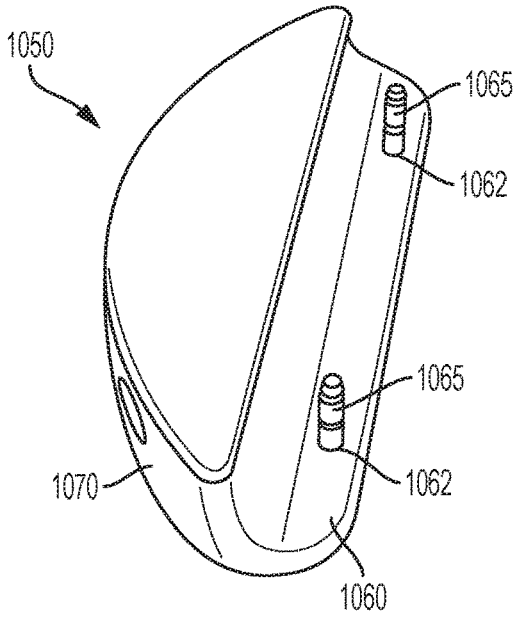
FIGS. 27A and 27B are enlarged isolated views of the cartridge housing of the sanitaryware cleaning system shown in FIGS. 25A-25C, 26A, and 26B.
Figure 27B:
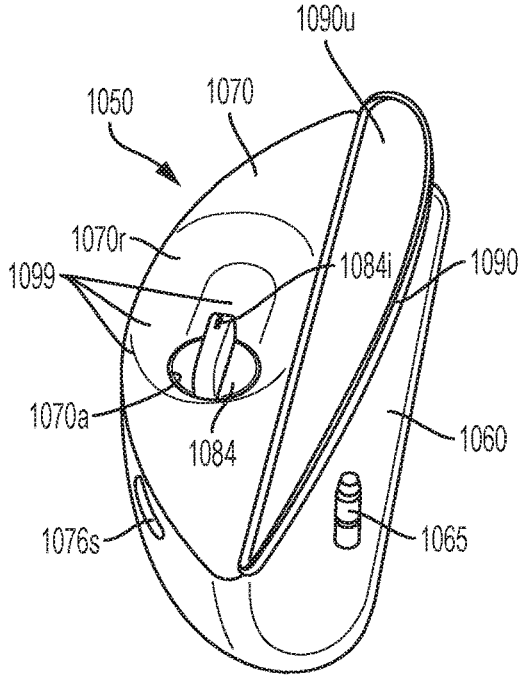
Figure 28A:
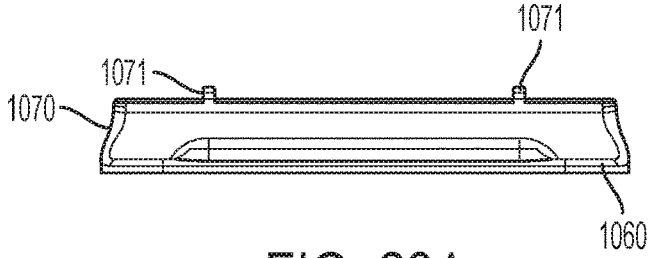
FIGS. 28A, 28B, 29, and 30 are various views of component parts of the cartridge housing shown in FIGS. 27A and 27B.
Figure 28B:
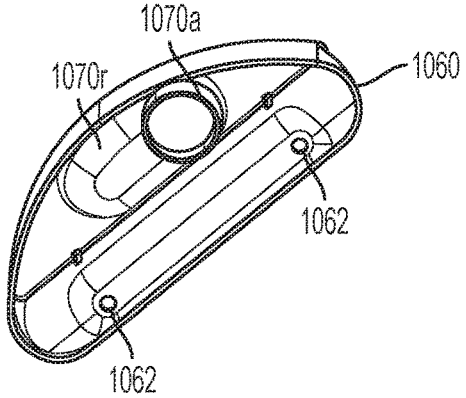

According to an exemplary embodiment, cartridge housing 1050 can include indicia that provide user instructions for installing/replacing cleaning product cartridge 1080. As shown in FIG. 27B, for example, housing 1050 can include indicia 1099 (e.g., on the surface of recess 1070*r* and/or on another suitable portion of platform 1070) in the form of text, symbols, and/or images, such as, for example, "Lock", "Unlock", and one or more padlock images, which can visually indicate to a user the proper direction to orient cartridge 1080, with respect to aperture 1070*a*, during installation/replacement of the cartridge. Cartridge 1080, and more particularly cap 1084, can also include a corresponding alignment indicator 1084*i* (FIG. 27B).

In some embodiments, aperture 1070*a* can be defined slightly off-center in platform 1070 so as to accommodate indicia 1099 on recess 1070*r*. Alternatively, aperture 1070*a* can be placed near the center of recess 1070*r* (and platform 1070), and indicia 1099 can be placed near the aperture.

Figure 41:
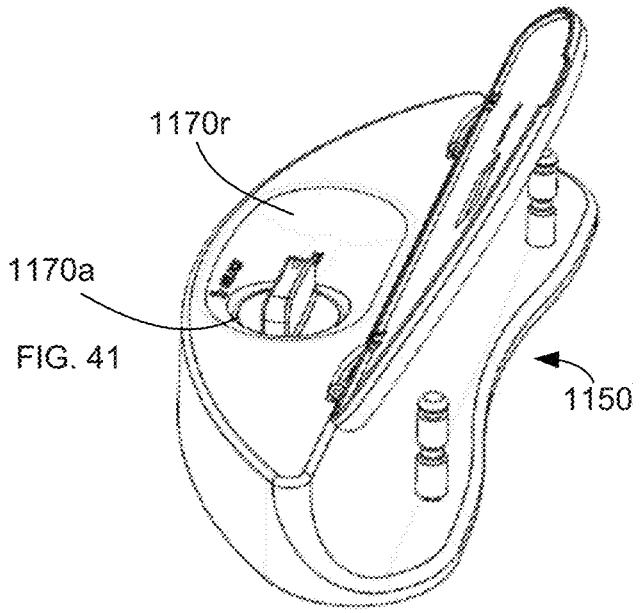
FIGS. 41 and 42 are perspective views of alternate cartridge housings, in accordance with embodiments of the present invention.
Figure 42:
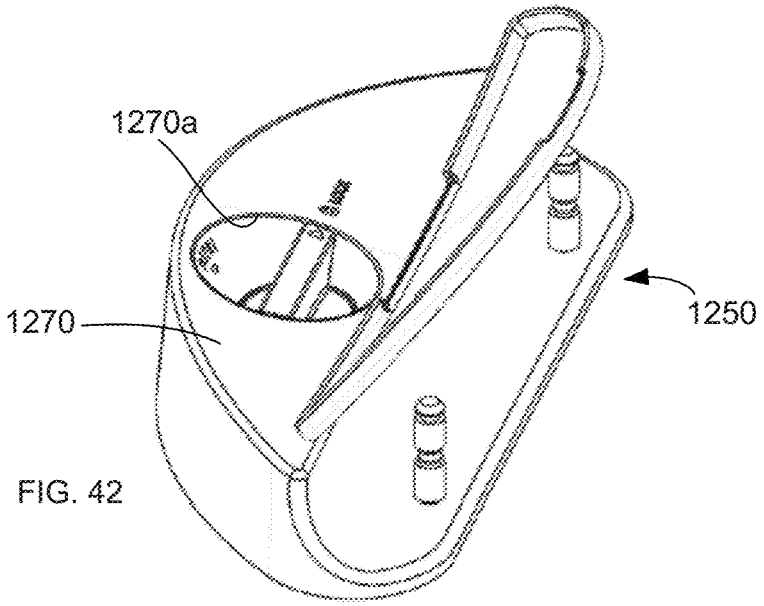

Further embodiments of the sanitaryware cleaning system can include cartridge housings having different constructions. Referring to FIG. 41, a cleanser assembly includes a cartridge housing 1150 having a receptacle or aperture 1170*a* defined in a more shallow recess 1170*r*. In certain embodiments, the lid of housing 1150 can include an opening that allows at least a portion of the cleaning product cartridge to pass therethrough (e.g., grip handle 1084 of cartridge 1080). Or, as shown in FIG. 42, cartridge housing 1250 may lack a recess altogether, having only an aperture 1270*a* defined on platform 1270.

It should be appreciated that cartridge housing 1050 can be composed of any suitable material (e.g., porcelain, metal, rubber, such as silicone rubber, plastic, such as polypropylene homopolymer, or the like), and can be manufactured in any suitable manner (e.g., by injection molding). Additionally, these components can be provided in an integrated structure or, alternatively, formed from separate components that are later integrated.

In various embodiments, the height of the cartridge housing can be substantially the same as the height of the fixture's seat/cover 1018 (FIG. 25C). This provides a cleanser assembly having a low profile, giving the appearance of being an integral part of the sanitary fixture.

Additionally, exemplary cleanser assemblies can be provided on tankless fixtures as well as those with tanks.

Accordingly, new, aesthetically pleasing sanitaryware include cleanser assemblies that are visually congruent with the sanitary fixtures. An exemplary cartridge housing is simple to install, easy to clean, and includes seat posts for supporting the fixture's seat/cover. The housing's low profile and curved shape complements the corresponding shape of the fixture's seat/cover, and provides a balanced look that makes the cleanser assembly appear to be an integral part of the sanitary fixture.

It will thus be seen that the aspects, features and advantages made apparent from the foregoing are efficiently attained and, since certain changes may be made without departing from the spirit and scope of the invention, it is intended that all matter contained herein shall be interpreted as illustrative and not in a limiting sense.

What is claimed is:

1. A cleanser assembly for a sanitary fixture, the fixture having a deck, a bowl, and a compartment defined in the deck in fluid communication with a waterway leading into the bowl, the assembly comprising a housing mountable onto the deck over the compartment, the housing being configured to receive a cartridge configured to contain a cleaning product, wherein the cartridge is configured for insertion into the compartment such that the cleaning product is introduced into the waterway and wherein the housing is configured to couple to a toilet seat.

2. The cleanser assembly of claim 1, wherein the fixture includes the toilet seat and a cover, and wherein the housing at least partially supports the toilet seat and the cover.

3. The cleanser assembly of claim 2, wherein the housing is shaped to present as an integral part of the seat and cover when installed to the fixture.

4. The cleanser assembly of claim 3, wherein the housing and the seat and cover together form a substantially elliptical shape when installed to the fixture.

5. The cleanser assembly of claim 2, wherein, when the housing is mounted onto the deck, the height of the housing is substantially the same as the height of the cover.

6. The cleanser assembly of claim 2, wherein the housing includes at least one seat post configured to at least partially support a hinged rear portion of the seat and cover.

7. The cleanser assembly of claim 1, wherein the housing includes an aperture configured to receive the cartridge.

8. The cleanser assembly of claim 7, further comprising a spud assembly at least partially disposed in the aperture, the spud assembly being configured to engage the cartridge and provide a substantially water-tight seal.

9. The cleanser assembly of claim 8, wherein the spud assembly includes a spud having at least one slot and at least one channel configured to engage corresponding protrusions on the cartridge to lock the cartridge in installed position.

10. The cleanser assembly of claim 1, wherein the housing includes a lid operable to conceal the cartridge when the cartridge is fully received in the housing.

11. The cleanser assembly of claim 10, wherein the housing further comprises a hinge assembly configured to bias the lid in open position.

12. The cleanser assembly of claim 11, wherein the hinge assembly comprises a pair of spring-biased arms at least partially disposed in the housing, and a pair of flanges disposed on the lid and coupled to the arms.

13. The cleanser assembly of claim 11, wherein the hinge assembly comprises a pair of curved channels defined in the housing, a pair of springs and a pair of curved arms disposed in the channels, and a pair of flanges disposed on the lid and coupled to the arms.

14. The cleanser assembly of claim 10, wherein the housing further comprises a magnetic latch assembly configured to releasably maintain the lid in closed position.

15. The cleanser assembly of claim 14, wherein the magnetic latch assembly comprises first and second magnetic elements, the first magnetic element being coupled to one of a surface of the housing and a latch, and the second magnetic element being coupled to the lid.

16. The cleanser assembly of claim 1, wherein the cartridge is received in the housing, the cartridge having an elongate body portion containing the cleaning product, the body portion having at least one slot that allows water to contact the cleaning product.

17. A sanitaryware cleaning system, comprising a sanitary fixture having a deck, a bowl, and a compartment defined in the deck in fluid communication with a waterway leading into the bowl; and the cleanser assembly as claimed in claim 1.

18. A sanitary fixture comprising the cleanser assembly as claimed in claim 1.

19. A toilet comprising the cleanser assembly as claimed in claim 1.

20. The cleanser assembly of claim 1, further comprising the cartridge, the cartridge configured to contain a cleaning product and configured for insertion in the compartment such that the cleaning product is introduced into the waterway.

* * * * *